US009138070B1

(12) United States Patent
Shamie et al.

(10) Patent No.: US 9,138,070 B1
(45) Date of Patent: Sep. 22, 2015

(54) PORTABLE BASSINET

(71) Applicant: Delta Enterprise Corp., New York, NY (US)

(72) Inventors: Sam L. Shamie, New York, NY (US); Francisco J. Reyes, New York, NY (US)

(73) Assignee: Delta Enterprise Corp., New York, NY (US)

( * ) Notice: Subject to any disclaimer, the term of this patent is extended or adjusted under 35 U.S.C. 154(b) by 0 days.

(21) Appl. No.: 14/676,371

(22) Filed: Apr. 1, 2015

(51) Int. Cl.
*A47D 9/00* (2006.01)
*A47D 7/00* (2006.01)

(52) U.S. Cl.
CPC ..... *A47D 9/005* (2013.01); *A47D 7/002* (2013.01)

(58) Field of Classification Search
CPC ..... A47D 9/005; A47D 7/002
USPC ..... 5/98.1, 99.1, 102
See application file for complete search history.

(56) References Cited

U.S. PATENT DOCUMENTS

| | | | | | |
|---|---|---|---|---|---|
| 3,063,065 | A * | 11/1962 | Shaw | ..... | 5/99.1 |
| 3,119,124 | A * | 1/1964 | Krauss | ..... | 5/99.1 |
| 3,233,254 | A * | 2/1966 | Leo et al. | ..... | 5/99.1 |
| 4,499,619 | A * | 2/1985 | Kassai | ..... | 5/99.1 |
| 4,635,305 | A * | 1/1987 | Wyss | ..... | 5/99.1 |
| 5,193,234 | A * | 3/1993 | Joaquin | ..... | 5/99.1 |
| 6,588,033 | B1 * | 7/2003 | Welsh et al. | ..... | 5/99.1 |

* cited by examiner

*Primary Examiner* — Michael Trettel
(74) *Attorney, Agent, or Firm* — Richard M. Goldberg

(57) ABSTRACT

A portable bassinet includes two mattress support halves, a lower pivoting arrangement for providing pivoting movement of the two mattress support halves between open and closed positions, legs connected with the mattress support halves, an upper support frame having two upper support members, an upper pivoting arrangement for providing pivoting movement of the two upper support members between the open and closed positions, connection members which connect the lower pivoting arrangement to the upper pivoting arrangement such that the lower pivoting arrangement and the upper pivoting arrangement are always a fixed distance from each other during movement of the bassinet between the open operative position and the closed storage position.

20 Claims, 26 Drawing Sheets

PORTABLE BASSINET

BACKGROUND OF THE INVENTION

The present invention relates generally to bassinets, and more particularly, is directed to a bassinet that folds into a compact configuration.

Bassinets are well known substitutes for large cribs, particularly for newborn infants, because of their smaller size. Because of their small size, they are generally well suited for transportation to and storage at different locations.

However, because of their smaller size, and their elevation off the floor by small diameter legs, they are generally less stable than a crib. In addition, folding of a bassinet for transportation and storage can become difficult.

It is known from U.S. Pat. No. 6,588,033 to Welsh, Jr. et al to provide a portable bassinet that is hinged at its center and pulls up from its center to a compact configuration. However, in order to ensure that the bassinet does not accidentally fold, this bassinet provides four tension bars, two at opposite ends of each side. This makes it more difficult to open and lock the bassinet in its operating configuration and to move the bassinet to its closed, compact configuration.

SUMMARY OF THE INVENTION

Accordingly, it is an object of the present invention to provide a portable bassinet that overcomes the aforementioned problems.

It is another object of the present invention to provide a portable bassinet that folds flat and compact for storage and transportation.

It is still another object of the present invention to provide a portable bassinet in which the bed portion is very flat and strong in operation.

It is yet another object of the present invention to provide a portable bassinet that cannot fold when the legs are on the floor.

It is a further another object of the present invention to provide a portable bassinet that easily folds into a compact configuration by lifting the center hub.

In accordance with an aspect of the present invention, a portable bassinet includes first and second mattress support halves. A lower pivoting arrangement is secured to the first and second mattress support halves for providing pivoting movement of the first and second mattress support halves between an open operative position where the mattress support halves are coplanar, and a closed storage position where the mattress support halves are in parallel, spaced apart relation to each other. A lower support is connected with the mattress support halves for supporting the mattress support halves on a ground surface. An upper support frame includes first and second upper support members, and an upper pivoting arrangement is secured to the first and second upper support members for providing pivoting movement of the first and second upper support members between the open operative position where the first and second upper support member are coplanar, and the closed storage position where the upper support members are in parallel, spaced apart relation to each other. At least one connection member connects the lower pivoting arrangement to the upper pivoting arrangement such that the lower pivoting arrangement and the upper pivoting arrangement are always a fixed distance from each other during movement of the bassinet between the open operative position and the closed storage position.

The at least one connection member includes at least one elongated member having a lower end which is connected to and forms the lower pivoting arrangement and an upper end which is connected to the upper pivoting arrangement.

The lower pivoting arrangement includes a first lower pivoting assembly secured to the first and second mattress support halves at one side of the bassinet and a second lower pivoting assembly secured to the first and second mattress support halves at an opposite side of the bassinet. The upper pivoting arrangement includes a first upper pivoting assembly secured to the first and second upper support members at the one side of the bassinet and a second upper pivoting assembly secured to the first and second upper support members at the opposite side of the bassinet. The at least one connection member includes a first elongated member at the one side of the bassinet and having the lower pivoting arrangement at a lower end thereof, and a second elongated member at the opposite side of the bassinet and having the lower pivoting arrangement at a lower end thereof.

The lower pivoting arrangement includes a transverse extension at the lower end of each of the first and second elongated members, and a pivot extends through each of opposite ends of the transverse extension for pivotal connection with a respective mattress support half. The lower pivoting arrangement includes a bracket connected to each side of each mattress support half, and the pivot extends through each of opposite ends of the transverse extension for pivotal connection to a respective bracket.

In accordance with another aspect of the present invention, a portable bassinet includes first and second mattress support halves, and a lower pivoting arrangement secured to the first and second mattress support halves for providing pivoting movement of the first and second mattress support halves between an open operative position where the mattress support halves are coplanar, and a closed storage position where the mattress support halves are in parallel, spaced apart relation to each other. First and second lower support legs are provided on each side of the bassinet and connected with the mattress support halves for supporting the mattress support halves on a ground surface. An upper support frame is provided including first and second upper support members. An upper pivoting arrangement is secured to the first and second upper support members for providing pivoting movement of the first and second upper support members between the open operative position where the first and second upper support member are coplanar, and the closed storage position where the upper support members are in parallel, spaced apart relation to each other. A leg pivoting arrangement pivotally connects upper ends of the first and second lower support legs on each side of the bassinet, with the leg pivoting arrangement being movable toward the upper pivoting arrangement when the bassinet is moved to the open operative position and away from the upper pivoting arrangement when the bassinet is moved to the closed storage position.

The leg pivoting arrangement includes a first leg pivoting assembly pivotally secured to the upper ends of the first and second lower support legs at one side of the bassinet and a second leg pivoting assembly pivotally secured to the upper ends of the first and second lower support legs at an opposite side of the bassinet, and the upper pivoting arrangement includes a first upper pivoting assembly secured to the first and second upper support members at the one side of the bassinet and a second upper pivoting assembly secured to the first and second upper support members at the opposite side of the bassinet.

Each of the leg pivoting assemblies includes first and second side plates, and at least one connecting member for connecting together the first and second side plates in spaced apart relation, with upper ends of the legs pivotally connected to at least one of the first and second side plates, and positioned therebetween. Each of the leg pivoting assemblies also includes a stop member on the at least one connecting member for limiting an angular pivoting range in one direction of the legs. Further, the at least one connecting member includes a concave upper connecting member which is positioned immediately below the upper pivoting arrangement in the open operative position.

There is also at least one connection member which connects the lower pivoting arrangement to the upper pivoting arrangement such that the lower pivoting arrangement and the upper pivoting arrangement are always a fixed distance from each other during movement of the bassinet between the open operative position and the closed storage position.

The at least one connection member includes at least one elongated member having a lower end which is connected to and forms the lower pivoting arrangement and an upper end which is connected to the upper pivoting arrangement; and each of the leg pivoting assemblies includes a guide on one of the first and second side plates, which guides a respective elongated member for sliding movement relative to the leg pivoting arrangement when the bassinet is moved between the open operative position and the closed storage position.

There are also connecting members which connect together upper ends of the legs and the first and second upper support members.

In accordance with still another aspect of the present invention, a portable bassinet includes first and second mattress support halves, and a lower pivoting arrangement secured to the first and second mattress support halves for providing pivoting movement of the first and second mattress support halves between an open operative position where the mattress support halves are coplanar, and a closed storage position where the mattress support halves are in parallel, spaced apart relation to each other. A lower support is connected with the mattress support halves for supporting the mattress support halves on a ground surface, and an upper support frame is provided which includes first and second upper support members. An upper pivoting arrangement is secured to the first and second upper support members for providing pivoting movement of the first and second upper support members between the open operative position where the first and second upper support member are coplanar, and the closed storage position where the upper support members are in parallel, spaced apart relation to each other. The upper pivoting arrangement including a first pivot joint member connected to the first upper support member, a second pivot joint member connected to the first upper support member and rotatably connected to the first pivot joint member, and a joint lock movable between a first position in engagement with the first and second pivot joint members to prevent rotational movement therebetween and a second position out of engagement with one of the first and second pivot joint members to permit rotational movement therebetween.

The first pivot joint member includes a first locking recess, the second pivot joint member includes a second locking recess, and the joint lock is positioned within the first and second locking recesses in the open operational position to prevent rotational movement between the first and second pivot joint members. Specifically, each of the first and second locking recesses includes a circular recess with radially extending tab recesses, and the joint member includes a main cylindrical body to fit within the circular recesses and radially extending tabs to fit within the tab recesses.

The upper pivoting arrangement further includes a biasing arrangement for biasing the joint member to maintain the joint member in the first and second locking recesses to prevent rotational movement between the first and second pivot joint members, and an actuator for moving the joint member out of one of the first and second locking recesses to permit rotational movement between the first and second pivot joint members.

The actuator includes a push button axially movable along a pivot axis of the first and second pivot joint members for pressing against the joint member to move the joint member out of one of the first and second locking recesses against a force from the biasing arrangement. The biasing arrangement is preferably a coil spring located in one of the first and second locking recesses.

Also, the first pivot joint member includes an arcuate projection, and the second pivot joint member includes an arcuate recess which receives the arcuate projection for arcuate movement therein so as to define an angular range of motion between the first and second pivot joint members.

The above and other objects, features and advantages of the invention will become readily apparent from the following detailed description thereof which is to be read in connection with the accompanying drawings.

DETAILED DESCRIPTION

Figure 1:
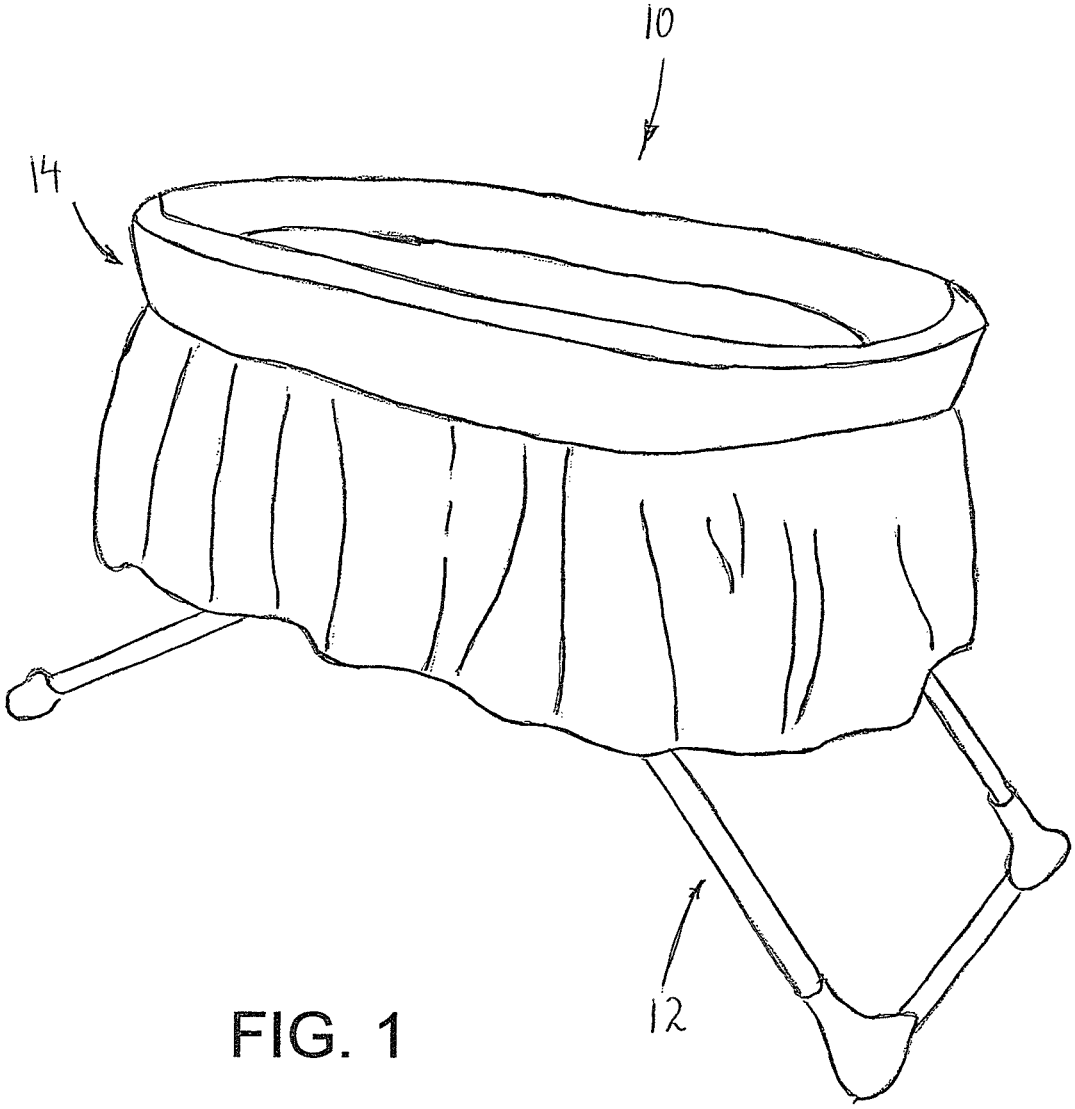
FIG. 1 is a perspective view of a portable bassinet according to the present invention.

Referring to the drawings in detail, a portable bassinet 10 according to the present invention includes a bassinet frame 12 and a flexible covering body 14.

Figure 4:
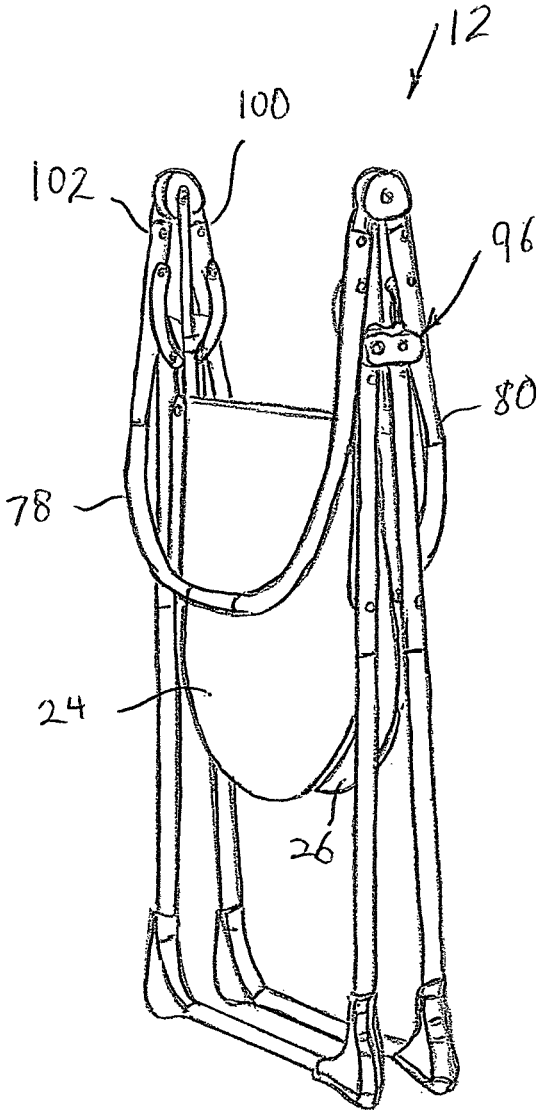
FIG. 4 is a perspective view of the frame of the bassinet in a fully closed, compact storage configuration.

Bassinet frame 12 includes a foldable planar mattress support 16, a lower support frame 18 connected to foldable mattress support 16, an upper support frame 20, and a pivoting connection assembly 22 which connects lower support frame 18 to upper support frame 20 in a manner to permit pivotable folding of mattress support 16, lower support frame 18 and upper support frame 20 between an open operative configuration (FIGS. 1 and 2) and a closed compact storage configuration (FIG. 4).

Figure 2:
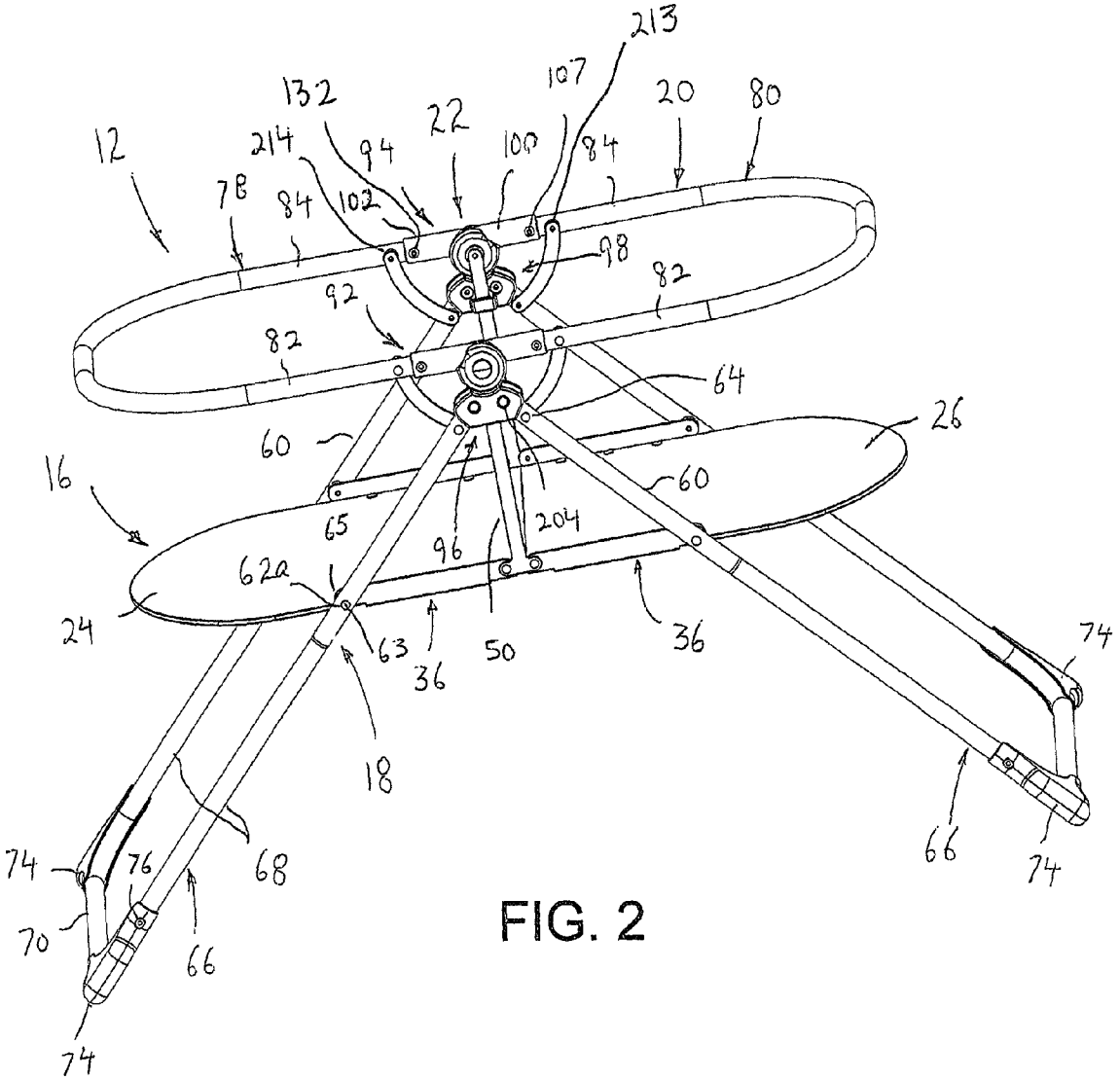
FIG. 2 is a perspective view of the frame of the bassinet in a fully opened configuration.
Figure 3:
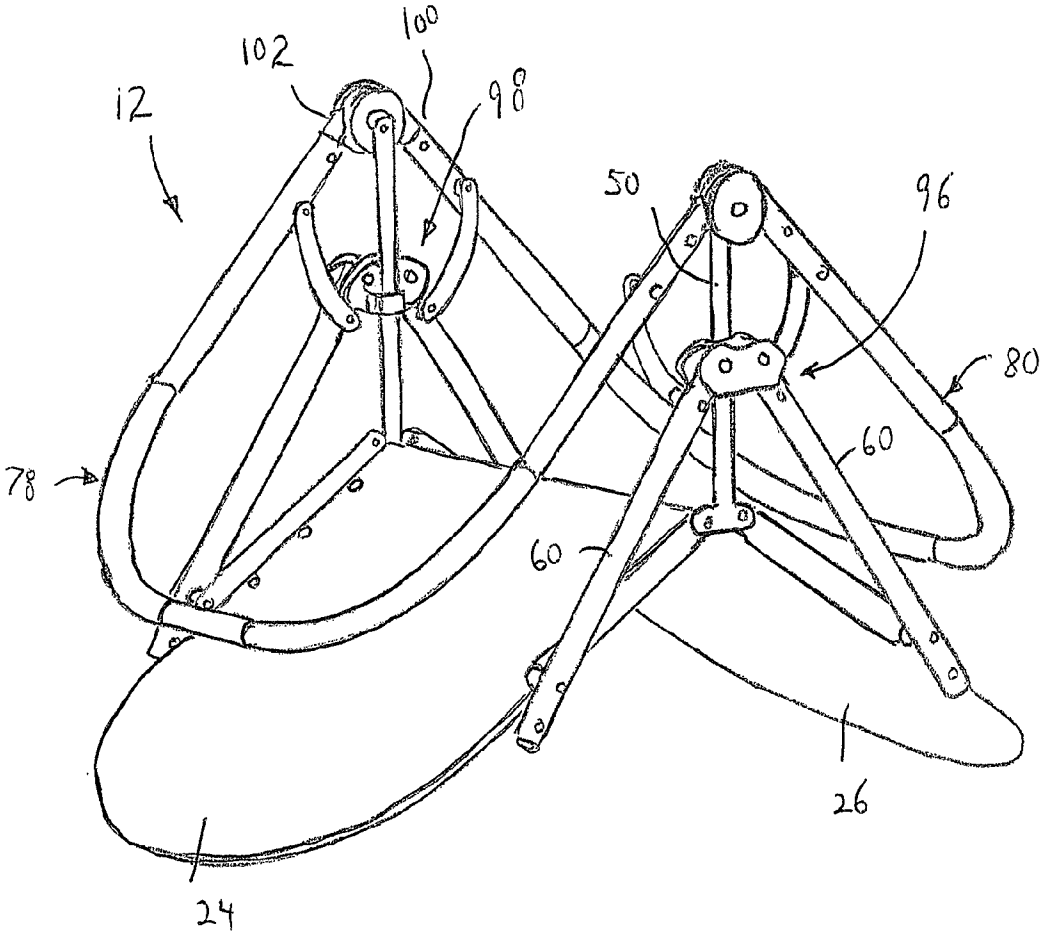
FIG. 3 is a perspective view of the frame of the bassinet in a partially opened intermediate configuration.
Figure 5:
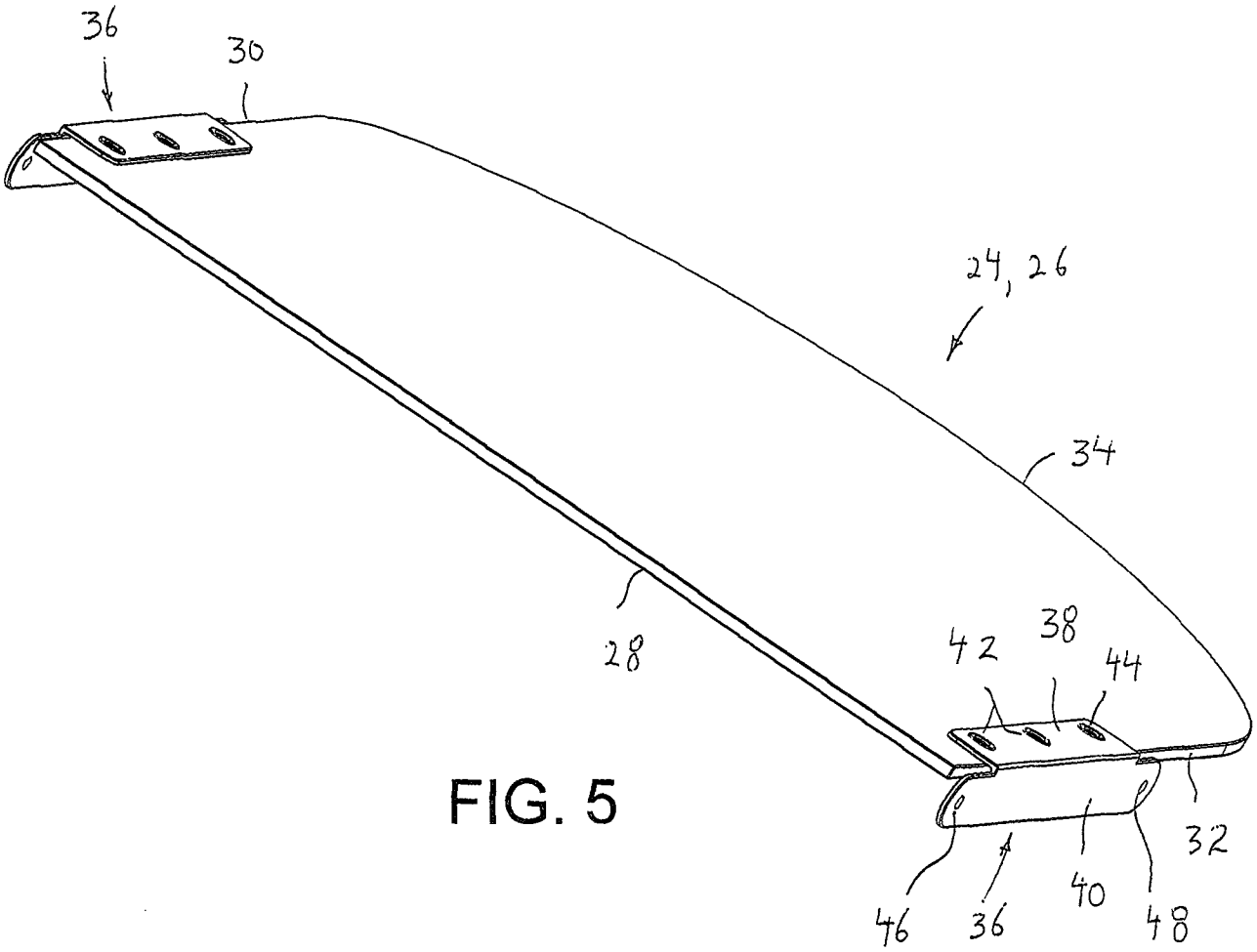
FIG. 5 is a perspective bottom view of one mattress support half.

As shown in FIGS. 2-4, mattress support 16 is made from two planar mattress support halves 24 and 26, each preferably having the configuration of half an oblong shape, that is, half of a rectangle with rounded ends. Thus, as shown best in FIGS. 2 and 5, each mattress support half 24 and 26 has an inner straight or linear transverse edge 28, opposite straight or linear side edges 30 and 32 which extend outwardly from opposite ends of linear transverse edge 28, and a rounded edge 34 that extends from opposite ends of linear side edges 30 and 32. Linear transverse edges 28 of mattress support halves 24 and 26 are in parallel, adjacent, but slightly spaced apart relation to each other. However, the present invention is not limited to this configuration of mattress support halves 24 and 26.

Lower support frame 18 includes four metal L-shaped brackets 36, each having a first elongated plate 38 of a first length and second elongated plate 40 of a second length greater than the first length, which is bent perpendicular to first elongated plate 38.

First elongated plate 38 has a plurality, for example, three, of elongated, parallel, spaced apart slots 42 therein and is positioned against the underside of a respective mattress support half 24 or 26 adjacent a linear side edge 30 or 32 thereof, such that each slot 42 extends in a direction transverse to the respective side edge 30 or 32. A screw 44 is inserted through each slot 42 and secured to the underside of the respective mattress support half 24 or 26 without piercing entirely therethrough. Because of slots 42, each L-shaped bracket 36 can be adjusted in the transverse direction.

Second elongated plate 40 extends parallel to and just to the outside of a respective linear side edge 30 or 32, and extends upwardly above the upper surface of the respective mattress support half 24 or 26, with one end of each second elongated plate 40 being adjacent the respective inner linear transverse edge 28. Second elongated plate 40 has a pivot opening 46 at one end adjacent the respective inner linear transverse edge 28 and a leg support opening 48 at the opposite end.

Figure 6:
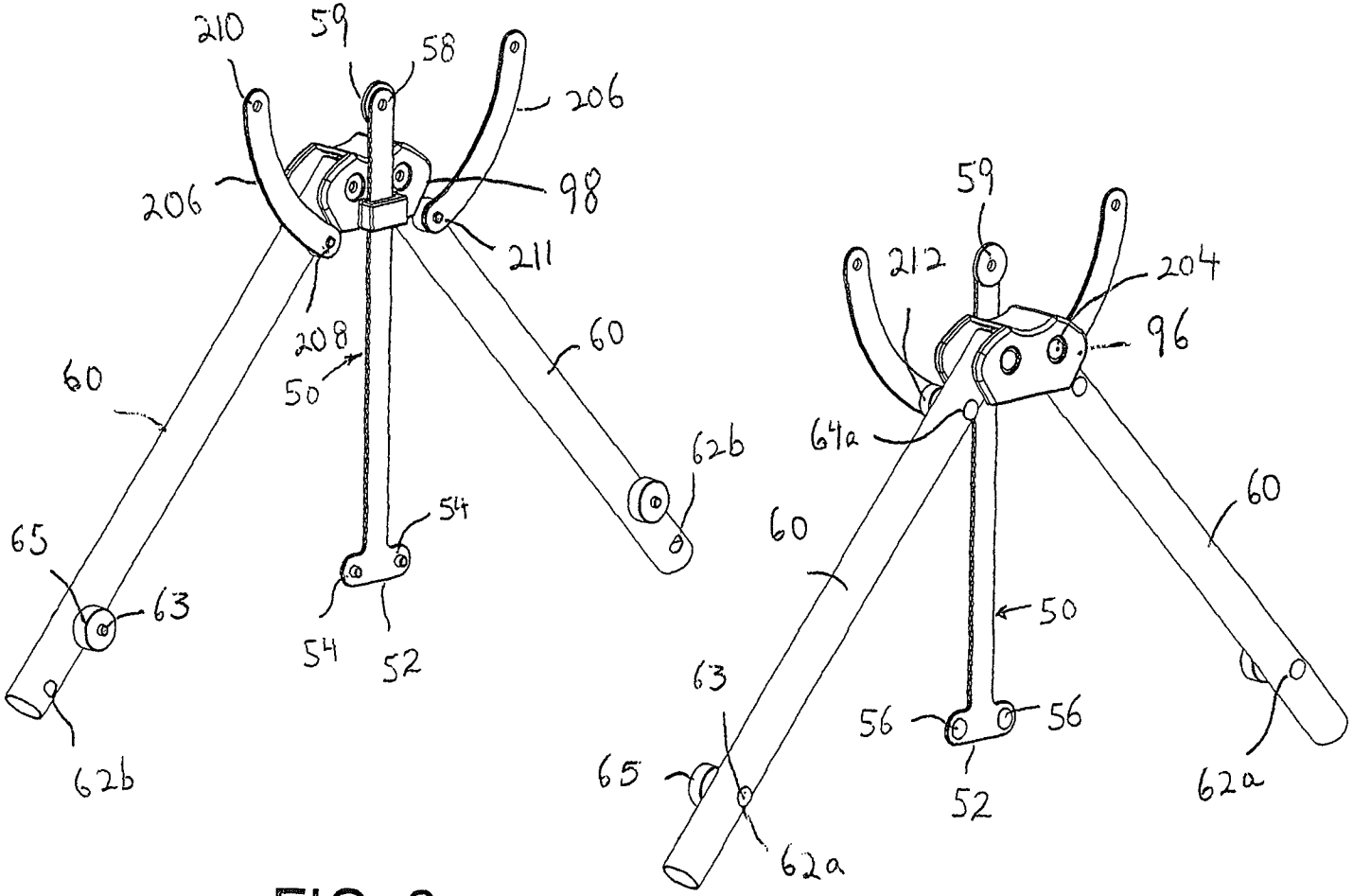
FIG. 6 is a perspective view of the legs, the pivoting assembly therefor and a guiding assembly.

As shown best in FIGS. 2 and 6, pivoting connection assembly 22 includes a vertically oriented, elongated metal slide plate 50 having a T-shaped lower end formed with a transverse extension plate 52 at the lower end thereof, which includes openings 54 at the outer ends thereof. Openings 54 are in alignment with respective pivot openings 46 and through which securing rivets 56 extend to connect each L-shaped bracket 36 to transverse extension plate 52. In this manner, mattress support halves 24 and 26 are pivotally connected to each other at their inner linear transverse edges 28. The upper end of elongated metal slide plate 50 has an opening 58.

Figures 5A, 5B:
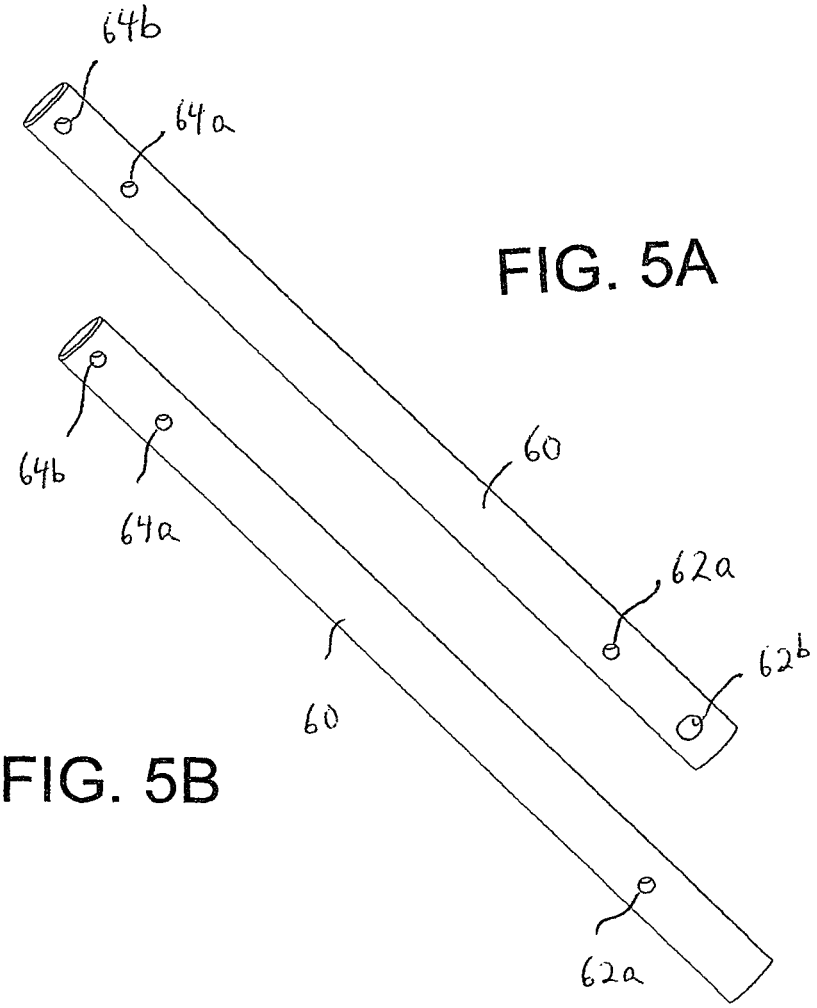
FIG. 5A is a perspective view of an inner side of one leg.
FIG. 5B is a perspective view of an outer side of one leg.

Lower support frame 18 further includes four metal tubular legs 60, two on each side of portable bassinet 10. As shown best in FIGS. 5A and 5B, each leg 60 has first and second spaced apart lower openings 62*a* and 62*b* at a lower end thereof, with opening 62*a* extending through both sides of each leg 60 and being in alignment with leg support opening 48 in a respective L-shaped bracket 36, and a rivet 63 extends through openings 48 and 62*a* to connect each leg 60 to an L-shaped bracket 36, with a cylindrical spacer 65 therebetween. Lower opening 62*b* which is closer to the lower end of each leg 60 only extends through the inner facing side of each leg 60. Each leg 60 also has first and second spaced apart upper through openings 64*a* and 64*b* at an upper end thereof which extend through both sides of each leg 60.

Figure 7:
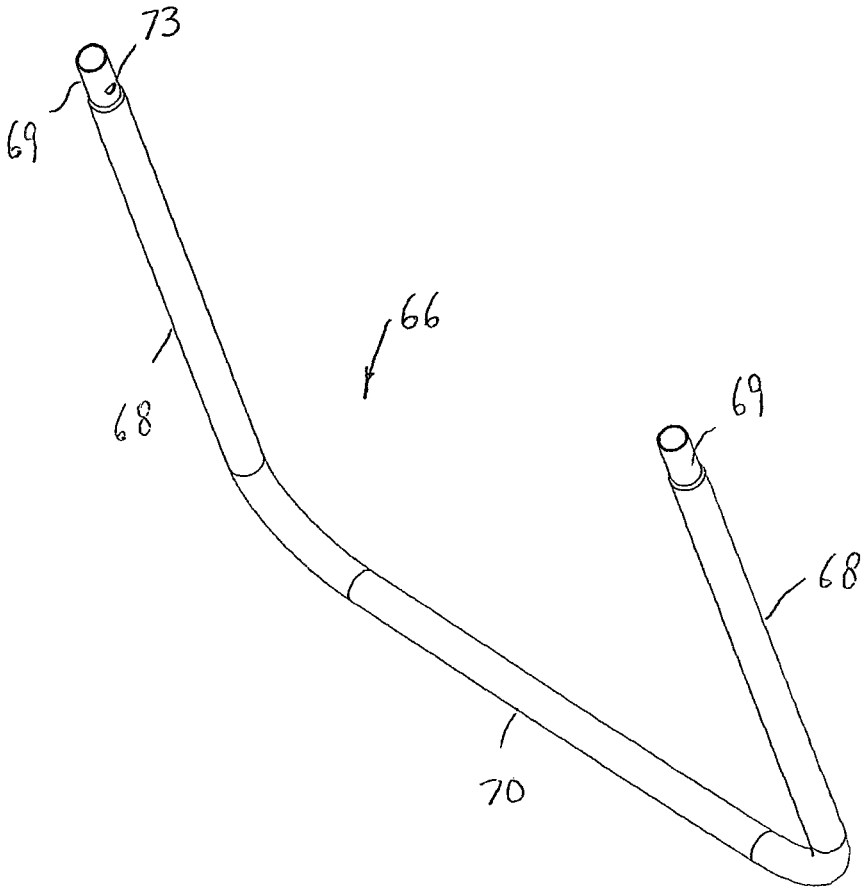
FIG. 7 is a perspective view of one lower U-shaped leg extension member.
Figure 8:
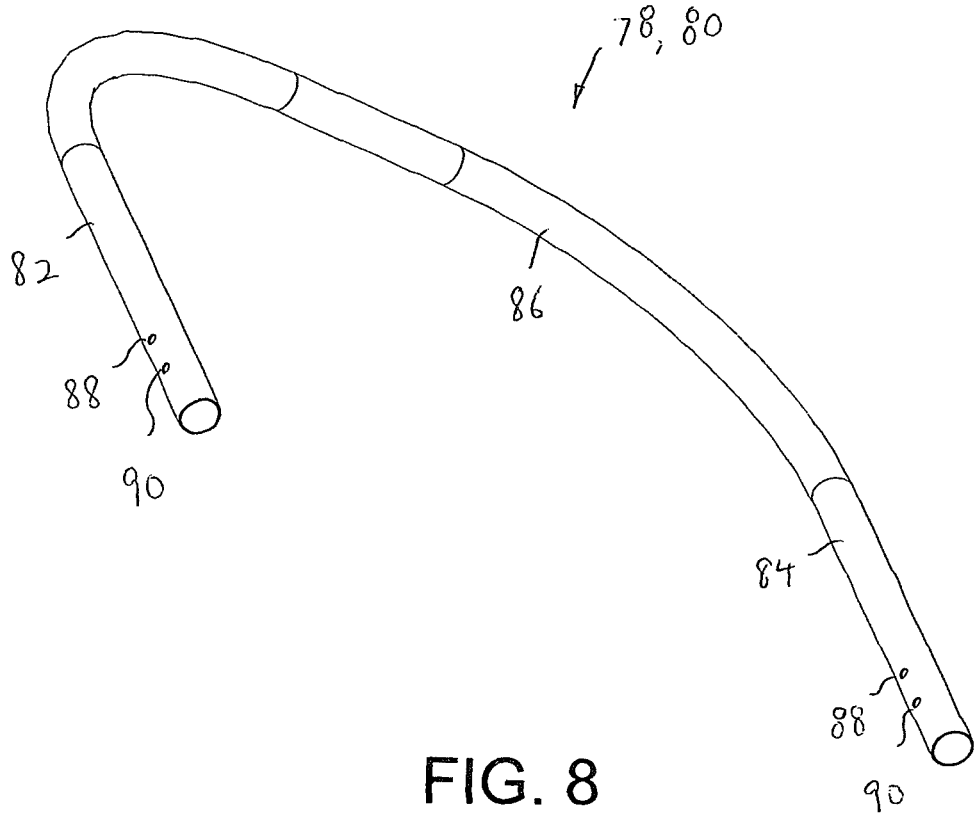
FIG. 8 is a perspective view of one upper tubular support member.
Figure 9:
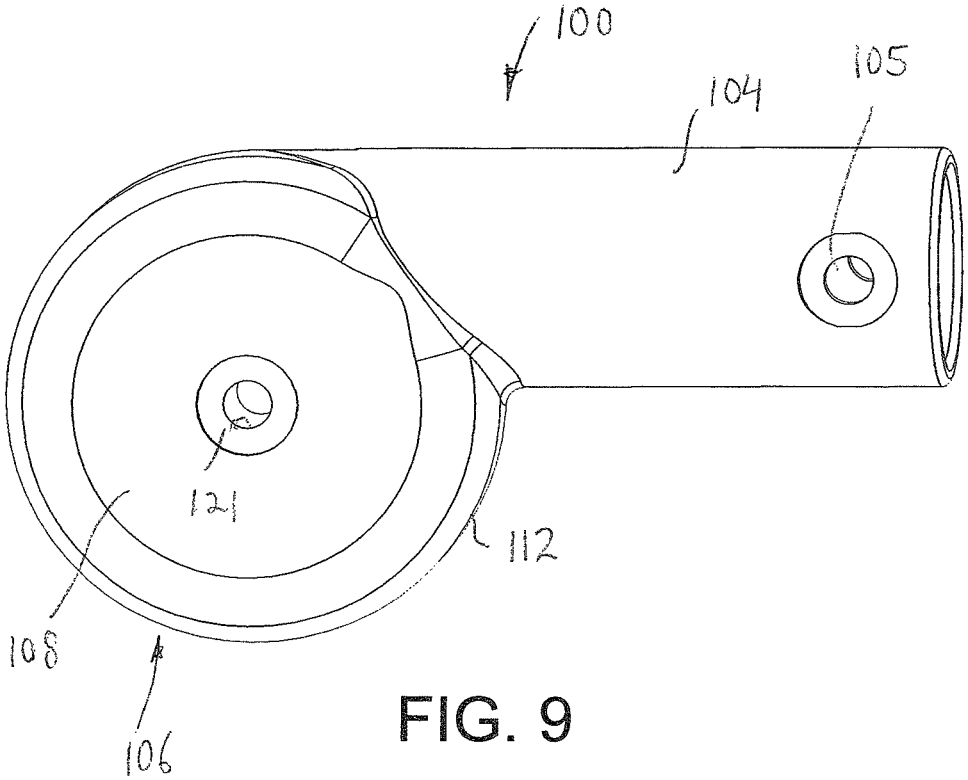
FIG. 9 is a perspective view of the outer facing side of one inner pivot joint member.
Figure 10:
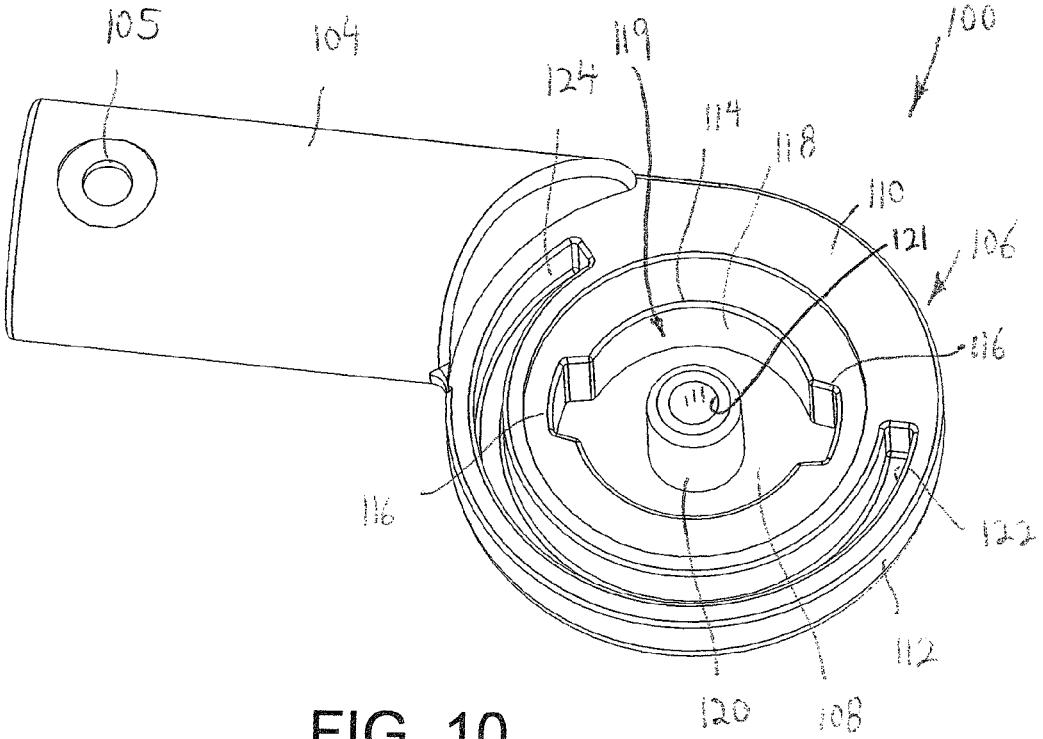
FIG. 10 is a perspective view of the inner facing side of one inner pivot joint member.

As shown in FIGS. 2 and 7, lower U-shaped, metal leg extension members 66 are connected to lower free ends of legs 40 for supporting portable bassinet 10 on a ground surface. Each leg extension member 66 includes two parallel, spaced apart tubular leg extensions 68 which are connected together at their lower ends by a tubular cross member 70. The upper free ends of tubular leg extensions 68 are connected to the lower ends of tubular legs 60 on opposite sides of portable bassinet 10 such that tubular cross member 70 rests on the ground surface. The connection of tubular leg extensions 68 to tubular legs 60 can be accomplished in any desired manner, although it is preferred that the upper free ends of tubular leg extensions 68 have a reduced diameter section 69 that snugly fits into the lower ends of tubular legs 60 in a telescoping manner, with reduced diameter sections 69 having openings 73 respectively, that line up with openings 62*b* when connected in the telescoping manner, and a bolt (not shown) which can be fit therein to secure these elements together.

In order not to mar a ground surface with the metal of tubular cross member 70, a plastic covering foot 74 is preferably inserted over opposite lower corners of U-shaped leg extension members 66 and secured to tubular leg extensions 68 and tubular cross member 70 by screws 76 inserted through openings in plastic cover foot 74.

Alternatively, lower U-shaped, metal leg extension members 66 can be eliminated, and instead, plastic caps (not shown) inserted over the lower ends of metal tubular legs 60 for resting on a ground surface.

As a further alternative, metal leg extension members 66 can be replaced with individual tubular leg extension members, rather than having a U-shaped leg extension member 66. Still further, leg extension members 66 and individual tubular leg extension members can be adjustable in height by any conventional means, for example, by forming the same with telescoping leg portions that can be connected at different heights and held therein by spring loaded pins engaged in holes in one of the telescoping leg portions. In this manner, as well, portable bassinet 10 can be oriented at an angle by adjusting one side higher than the other side.

Upper support frame 20 includes two U-shaped upper tubular support members 78 and 80, each preferably having the configuration of and slightly larger dimensions than the outer circumference of mattress support halves 24 and 26. In other words, each has the configuration of half an oblong shape, that is, half of a rectangle with rounded ends. Thus, each upper tubular support member 78 and 80 has parallel, spaced apart straight or linear side sections 82 and 84 which are positioned above and slightly outwardly of linear side edges 30 and 32 of mattress support halves 24 and 26, and a rounded edge section 86 that extends from opposite ends of linear side sections 82 and 84. First and second spaced apart transverse through openings 88 and 90 are provided through each linear side section 82 and 84 near the free end thereof.

Pivoting connection assembly 22 includes a first upper pivot connection assembly 92 on one side of bassinet 10 which pivotally connects together the inner free ends of linear side sections 82 of upper tubular support members 78 and 80 to each other, a second upper pivot connection assembly 94 on the opposite side of bassinet 10 which pivotally connects together the inner free ends of linear side sections 84 of upper tubular support members 78 and 80 to each other, a first lower pivot connection assembly 96 which pivotally connects together upper ends of tubular legs 60 on one side of bassinet 10 and a second lower pivot connection assembly 98 which pivotally connects together upper ends of tubular legs 60 on the opposite side of bassinet 10.

Specifically, each upper pivot connection assembly 92 and 94 includes inner pivot joint members 100 connected to linear side sections 82 and 84 of upper tubular support member 80, and outer pivot joint members 102 connected to adjacent respective linear side sections 82 and 84 of upper tubular support member 78, with inner and outer pivot joint members 100 and 102 pivotally connected to each other.

Figure 14:
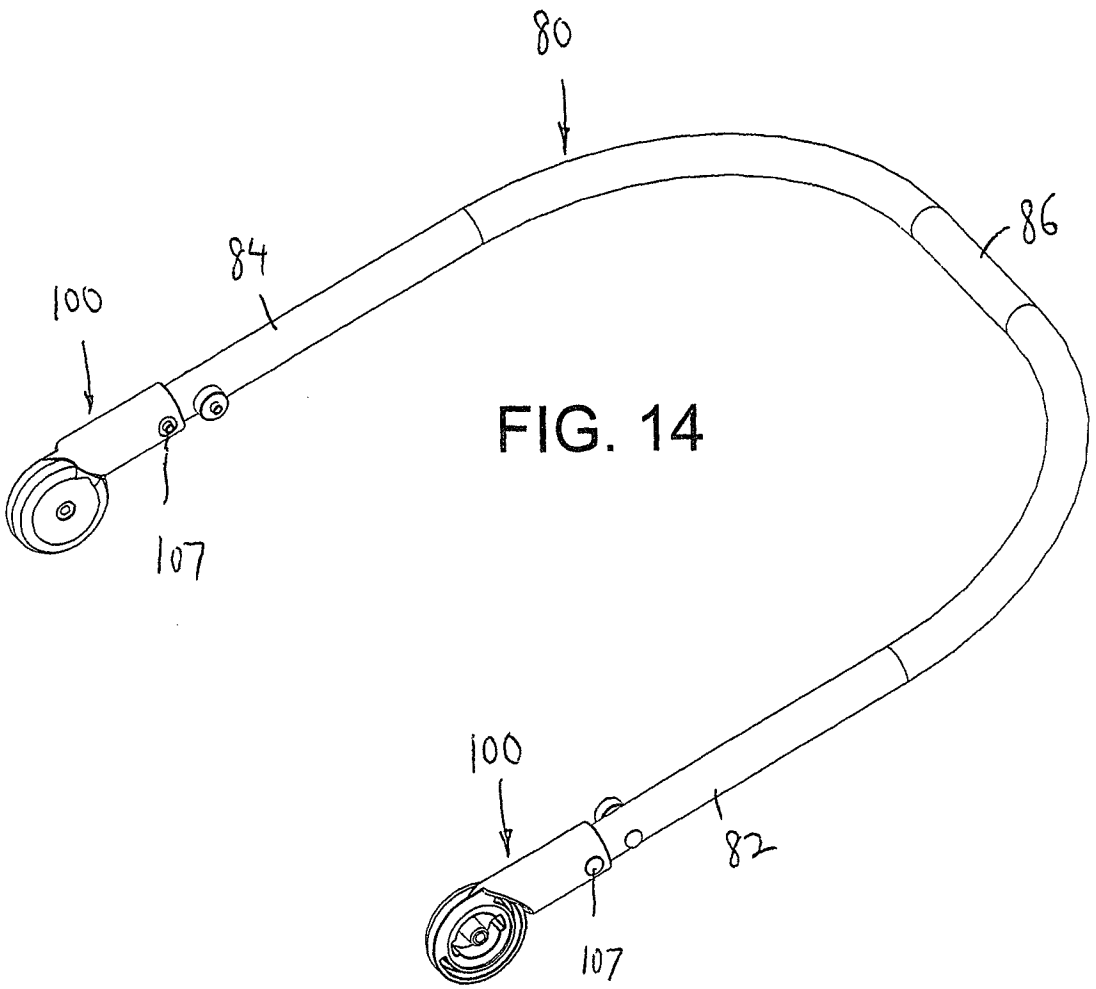
FIG. 14 is a perspective view of one U-shaped upper tubular support member and the inner pivot joint members at the ends thereof.

Each inner pivot joint member 100 includes a metal tubular section 104 and a cylindrical pivot section 106 at one end of tubular section 104. The opposite free or distal end of tubular section 104 fits snugly over a respective linear side section 82 or 84 of upper tubular support member 80, and has a through bore 105 at the distal end thereof which aligns with the opening 90 in the respective linear side section 82 or 84, and through which a rivet 107 extends for securing these elements together, as shown best in FIG. 14.

Cylindrical pivot section 106 includes an inner facing circular wall 108, an outer facing circular wall 110 and an outer annular side wall 112 that connects together circular walls 108 and 110 in a parallel, spaced apart arrangement. A central circular opening 114 with diametrically opposite tab openings 116 is formed in outer facing circular wall 110 and is defined by a first transverse wall 118 of the same dimensions which extends from the periphery of circular opening 114 and tab openings 116 into engagement with the internal surface of inner facing circular wall 108, thereby defining a first locking recess 119. A central boss 120 extends from the center of inner facing circular wall 108 within central circular opening 114 to a height just extending slightly higher than outer facing circular wall 110, and has a central through opening 121. Finally, an arcuate limiter recess 122 is formed in outer facing circular wall 110 in surrounding relation to circular opening 114 and tab openings 116 for an arcuate extent of about 230 degrees, and is defined by a second transverse wall 124 of the same dimensions which extends from the periphery of arcuate limiter recess 122 engagement with the internal surface of inner facing circular wall 108.

Figure 11:
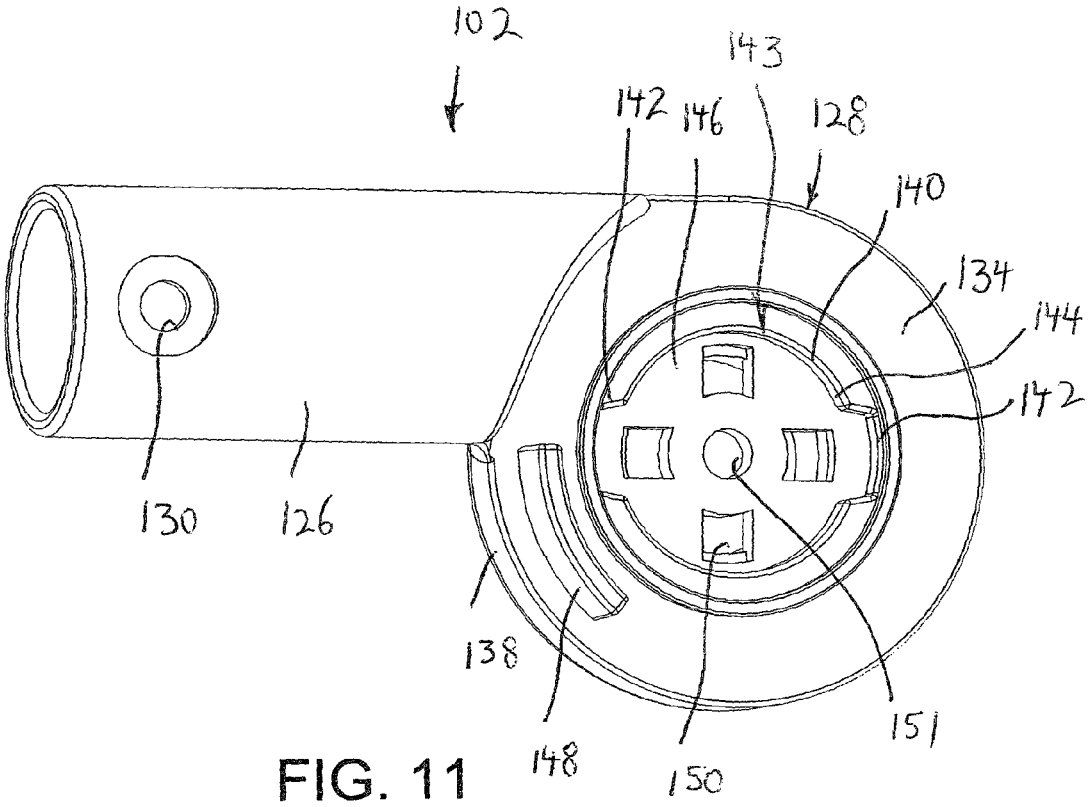
FIG. 11 is a perspective view of the inner facing side of one outer pivot joint member.
Figure 12:
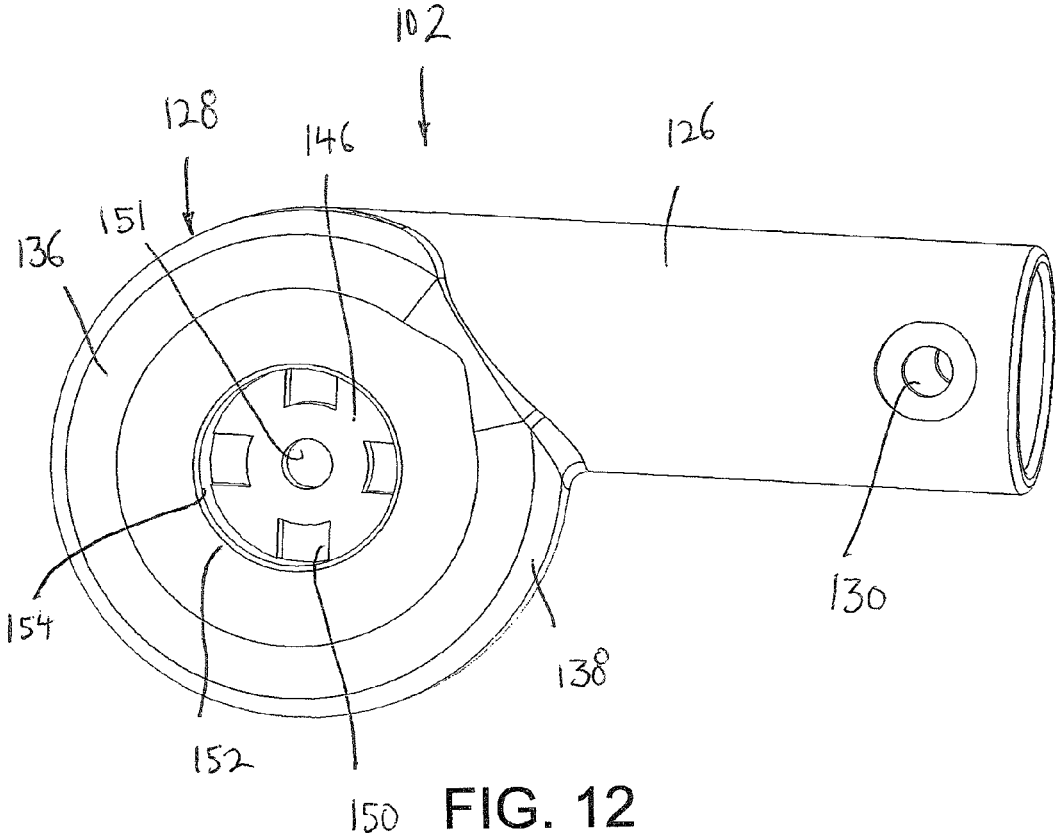
FIG. 12 is a perspective view of the outer facing side of one outer pivot joint member.

As shown best in FIGS. 11 and 12, each outer pivot joint member 102 includes a metal tubular section 126 and a cylindrical pivot section 128 at one end of tubular section 126. The opposite free or distal end of tubular section 126 fits snugly over a respective linear side section 82 or 84 of upper tubular support member 78, and has a through bore 130 at the distal end thereof which aligns with the opening 90 in the respective linear side section 82 or 84, and through which a rivet 132 extends for securing these elements together, as shown best in FIGS. 13 and 15.

Cylindrical pivot section 128 includes an inner facing circular wall 134, an outer facing circular wall 136 and an outer annular side wall 138 that connects together circular walls 134 and 136 in a parallel, spaced apart arrangement. A central circular opening 140 with diametrically opposite tab openings 142 is formed in inner facing circular wall 134 and is defined by a third transverse wall 144 of the same dimensions which extends from the periphery of circular opening 140 and tab openings 142 into engagement with a bottom wall 146 that extends parallel to and about midway between inner facing circular wall 134 and outer facing circular wall 136, thereby defining a second locking recess 143. Finally, an arcuate limiter projection wall 148 extends from inner facing circular wall 134 in surrounding relation to circular opening 140 and one tab opening 142 for an arcuate extent of about 50 degrees, although the present invention is not limited to this angle. As will be understood from the discussion hereafter, arcuate limiter projection wall 148 fits within arcuate limiter recess 122 and can move therein, wherein ends of arcuate limiter recess 122 function as stops for arcuate limiter projection wall 148 to define the pivoting action of upper tubular support members 78 and 80 relative to each other.

Four equiangularly spaced substantially square through openings 150 are formed in bottom wall 146, with the outer radial edges of each opening 150 being arcuate and formed about an imaginary circle having a lesser diameter than the diameter of central circular opening 140, so as to be spaced inwardly of third transverse wall 144. A small diameter central circular opening 151 extends centrally through bottom wall 146.

A central circular opening 152 of a smaller diameter than central circular opening 140, is formed in outer facing circular wall 136 and is defined by a fourth transverse wall 154 of the same dimensions as the imaginary circle defining square through openings 150 and which extends from the periphery of circular opening 152 into engagement with the opposite side of bottom wall 146, such that the outer radial edges of square through openings 150 end at fourth transverse wall 154.

When assembled, outer facing circular wall 110 of each inner pivot joint member 100 is in facing abutment or at least near abutment with inner facing circular wall 134 of a respective outer pivot joint member 102, and in coaxial alignment therewith. A rivet 156 (FIG. 13) extends through central through opening 121 of central boss 120 and small diameter central circular opening 151 in bottom wall 146 to hold inner pivot joint member 100 and outer pivot joint member 102 in this arrangement, so that they are rotatable relative to each other about rivet 156. In addition, rivet 156 extends through opening 58 at the upper end of elongated metal slide plate 50 with a cylindrical spacer 59 therebetween. As a result, elongated metal slide plate 50 slides vertically up and down with the pivotal movement of pivoting connection assemblies 22.

A joint lock 158 is fit within central circular opening 114 and tab openings 116 thereof of inner pivot joint member 100, as well as within circular opening 140 and tab openings 142 thereof of outer pivot joint member 102, to rotatably lock inner pivot joint member 100 and outer pivot joint member 102 together in the linearly aligned locking relationship shown in FIG. 2. This prevents pivoting of inner pivot joint member 100 and outer pivot joint member 102 relative to each other.

Figure 16:
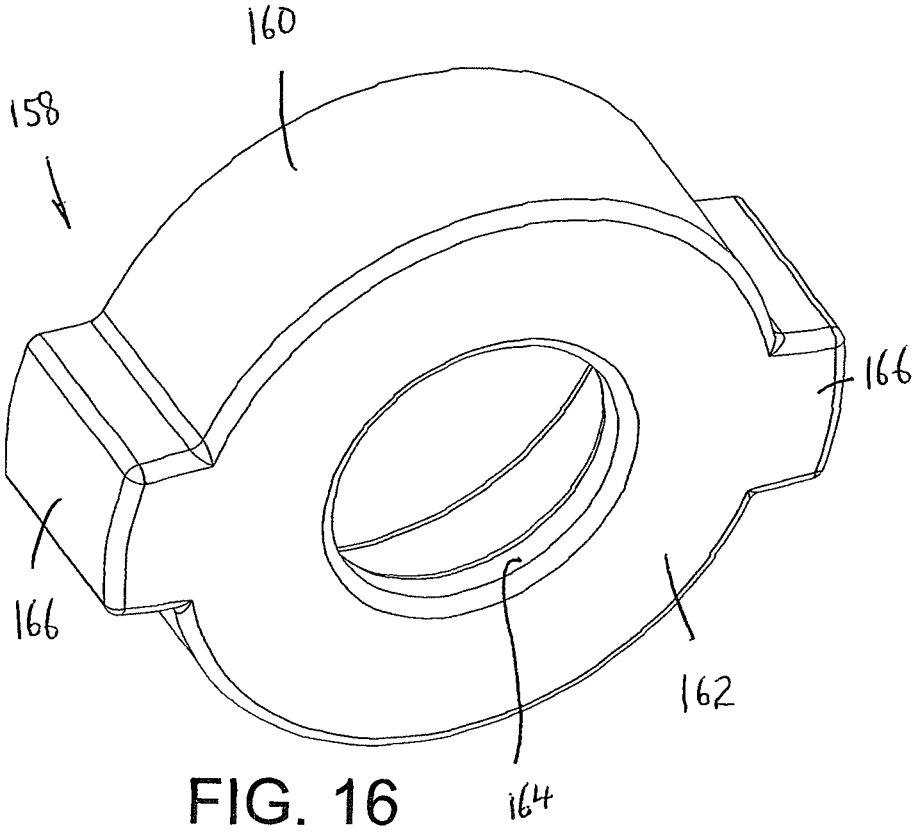
FIG. 16 is a perspective view of one side of the joint lock.
Figure 17:
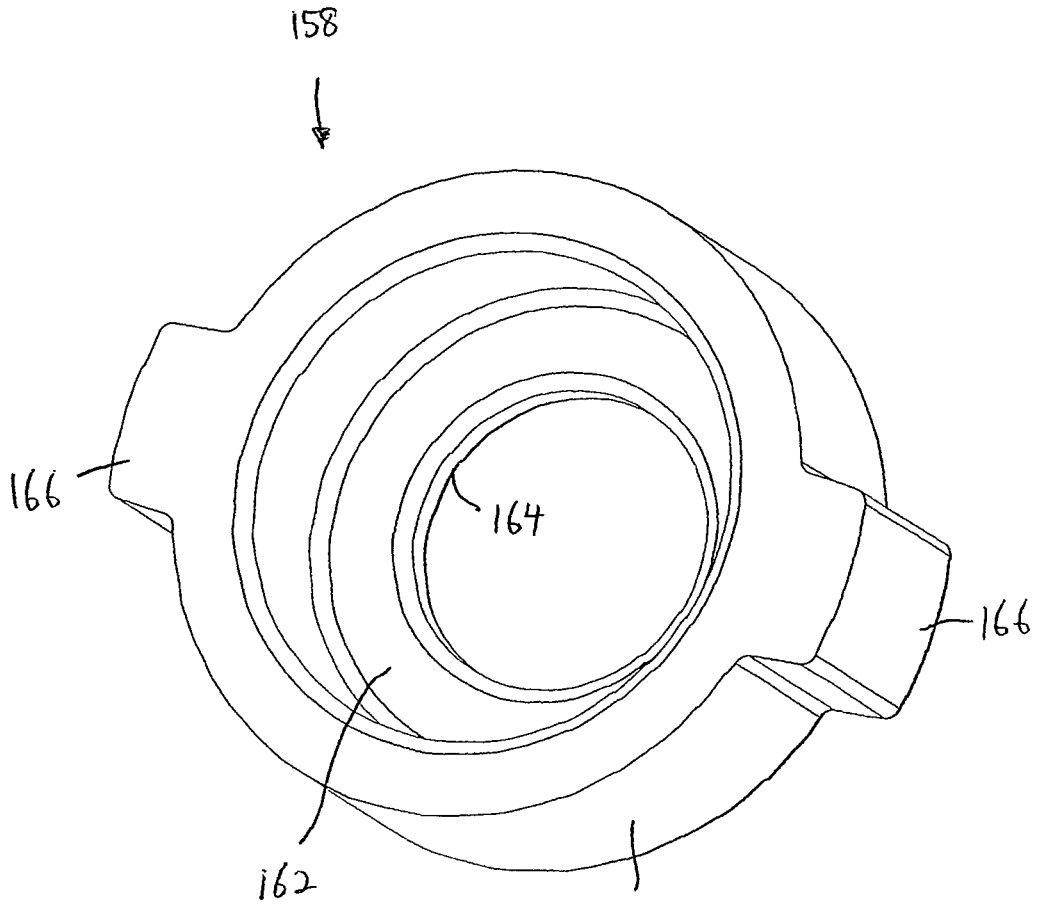
FIG. 17 is a perspective view of the other side of the joint lock.

As shown best in FIGS. 16 and 17, joint lock 158 includes an outer annular side wall 160 which is partially closed at one end by an annular planar end wall 162 having a central opening 164. Two tabs 166 extend diametrically out from opposite side of annular side wall 160. In this manner, outer annular side wall 160 fits within circular openings 114 and 140, and tabs 166 fit within tab openings 116 and 142, with annular planar end wall 162 positioned against the inner facing surface of bottom wall 146, in order to rotatably lock inner pivot joint member 100 and outer pivot joint member 102 relative to each other. In this condition, one edge of arcuate limiter projection wall 148 is abutted against an end of arcuate limiter recess 122 to define one rotational limit position.

Figure 13:
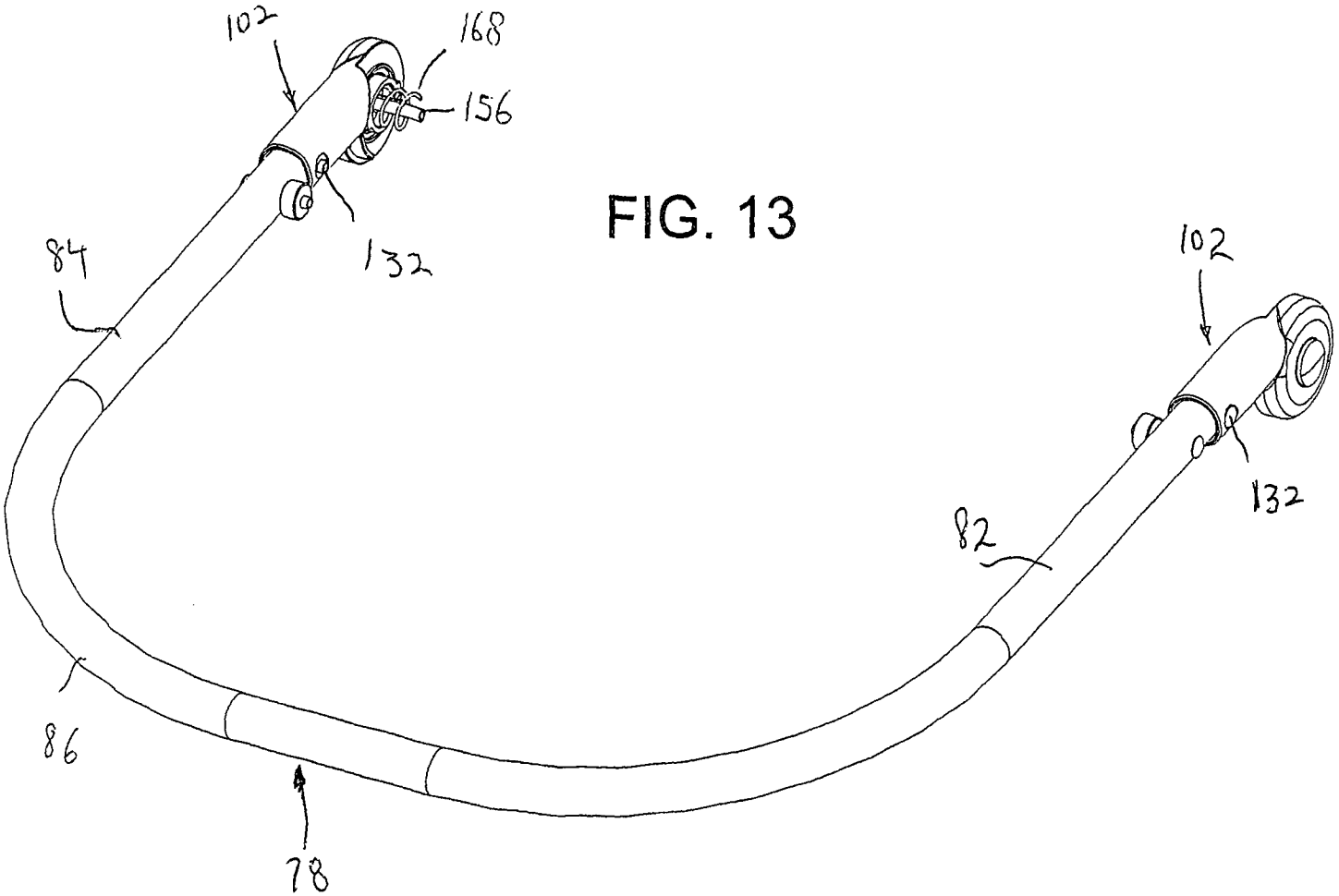
FIG. 13 is a perspective view of one U-shaped upper tubular support member and the outer pivot joint members at the ends thereof, along with the joint lock and biasing spring.
Figure 15:
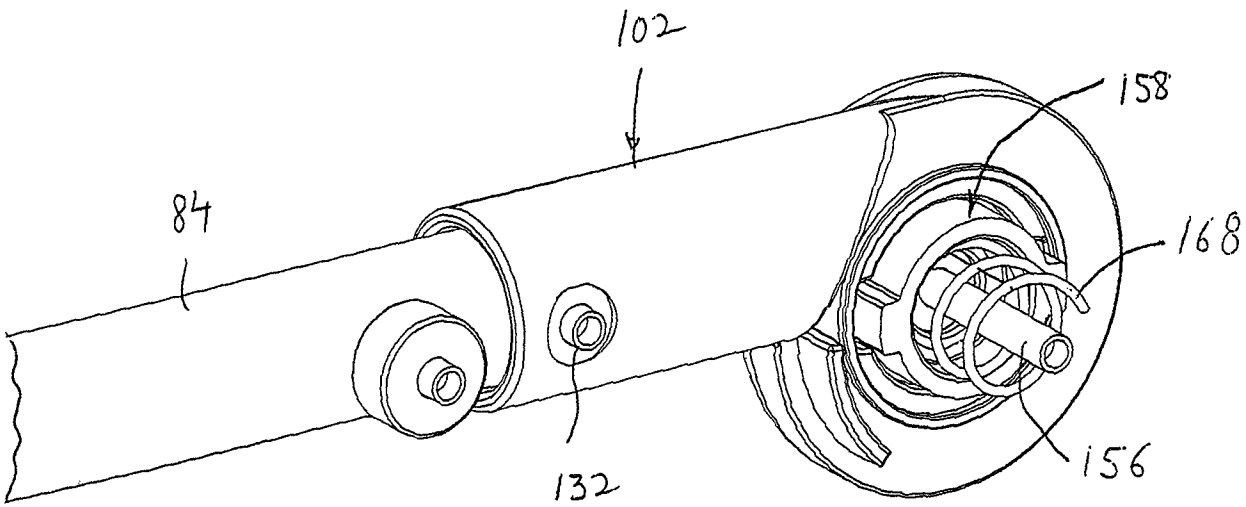
FIG. 15 is an enlarged perspective view of one U-shaped upper tubular support member and the outer pivot joint members at the ends thereof, along with the joint lock and biasing spring of FIG. 13.

As shown in FIGS. 13 and 15, a coil spring 168 is positioned within joint lock 158 and in surrounding relation to central boss 120, and has one end in contact with the inner facing surface of annular planar end wall 162 thereof, and the opposite end in contact with the outer facing surface of inner facing circular wall 108 of inner pivot joint member 100. In this manner, coil spring 168 functions to press joint lock 158 into central circular opening 140, and in this position, joint lock 158 is also positioned within central circular opening 114.

Figure 18:
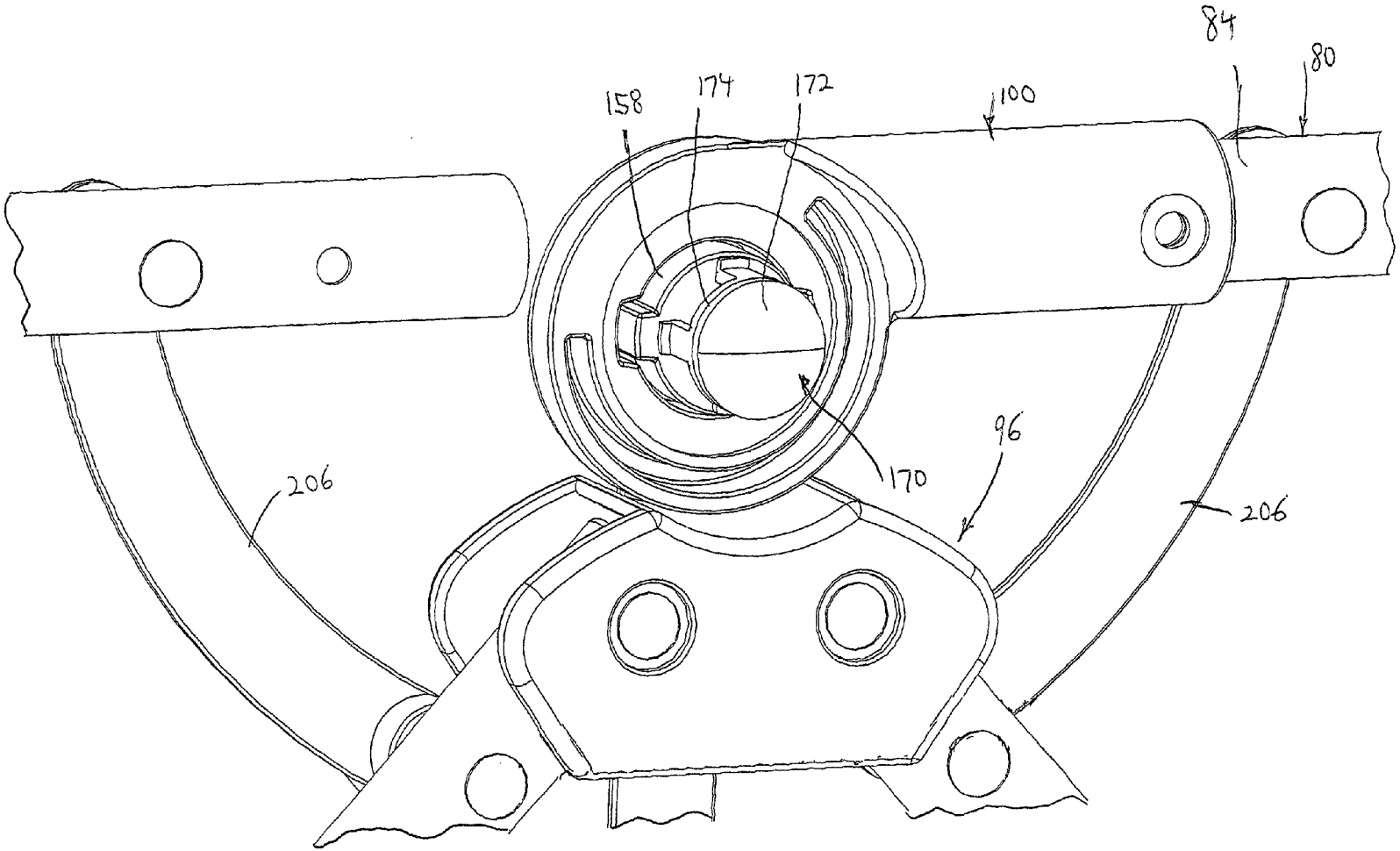
FIG. 18 is a perspective view of the upper pivot connection assembly with the outer pivot joint member removed to showing the push button and joint lock in relation to the inner pivot joint member.
Figure 19:
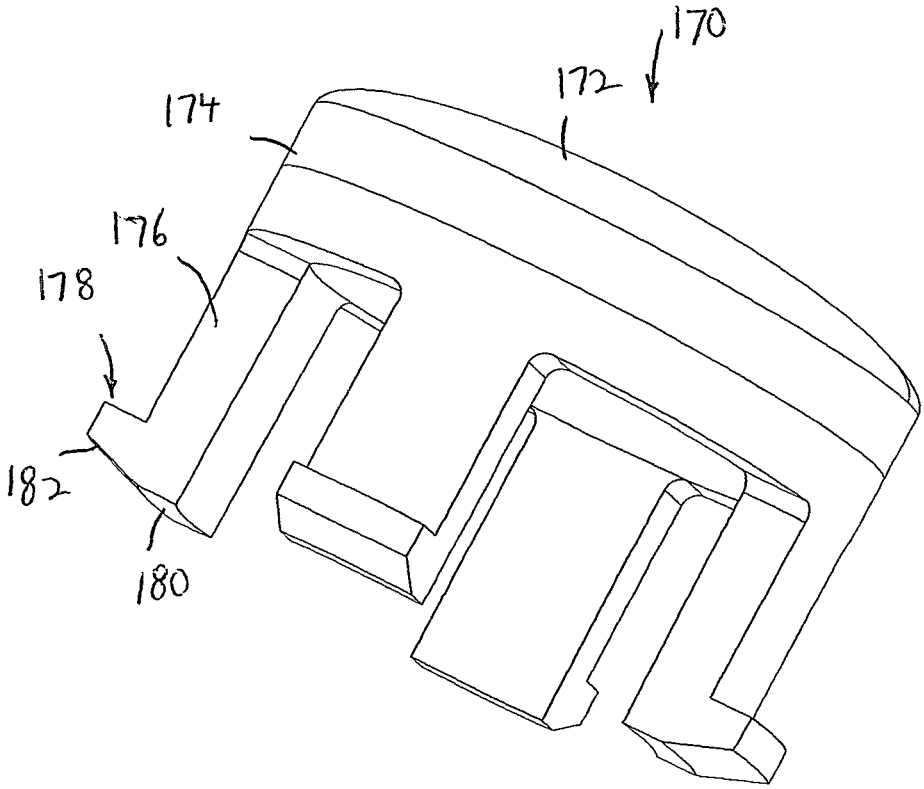
FIG. 19 is a perspective view of the push button.
Figure 20:
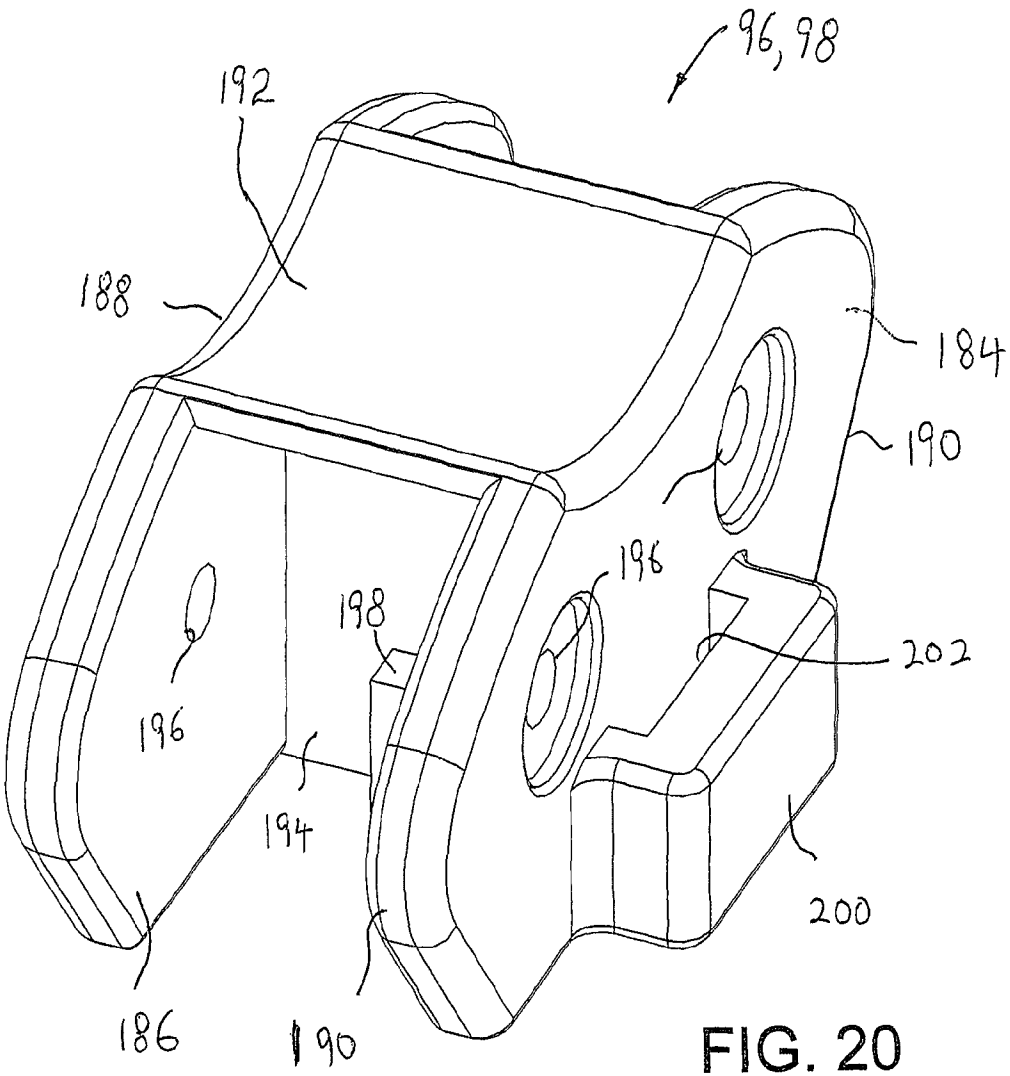
FIG. 20 is a top perspective view of one lower pivot connection assembly.
Figure 21:
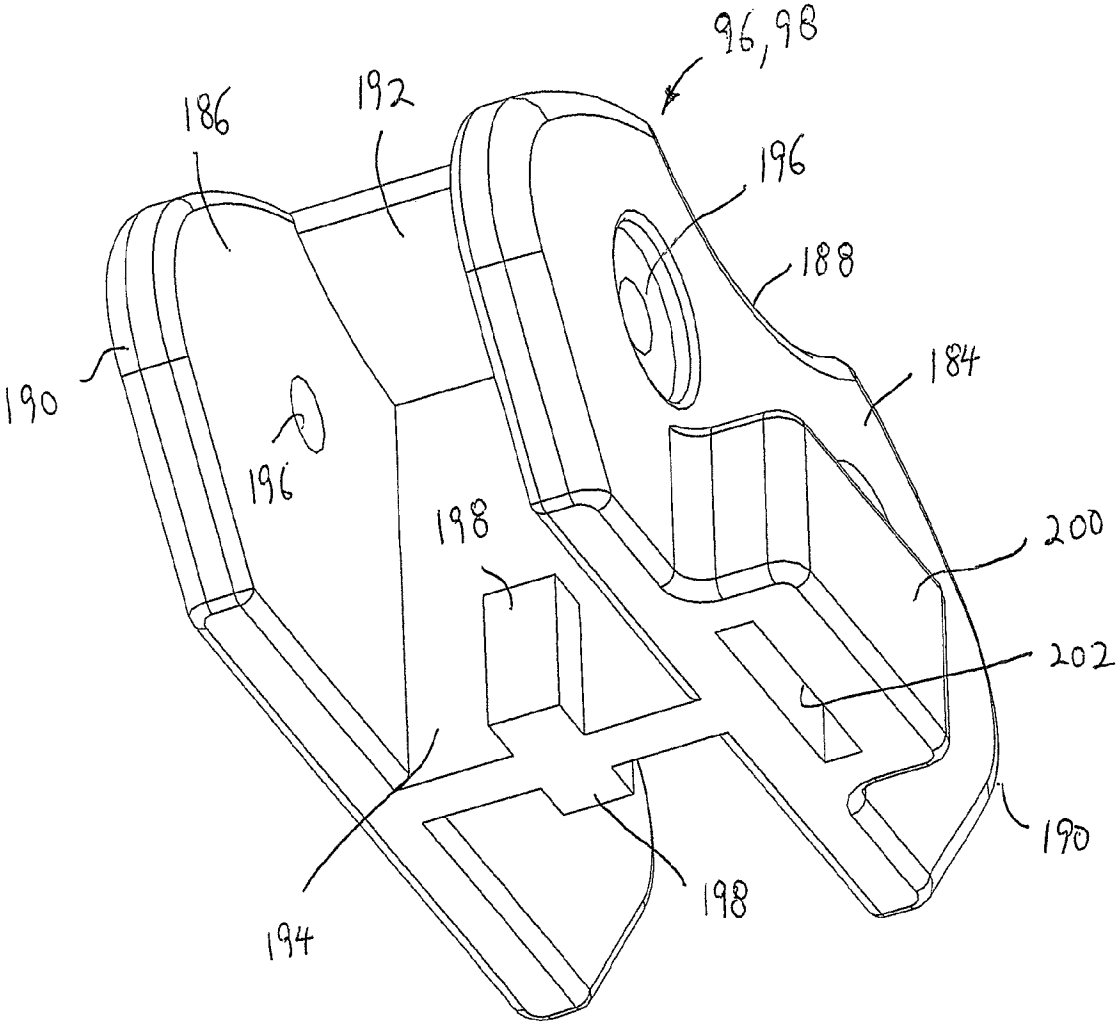
FIG. 21 is a bottom perspective view of one lower pivot connection assembly.

As shown in FIGS. 18 and 19, a joint push button actuator 170 includes a circular pressing wall 172 with an outer skirt 174. Circular pressing wall 172 has an outer diameter similar to the diameter of central circular opening 152 of outer pivot joint member 102. Four legs 176 equiangularly extend outwardly from the lower edge of outer skirt 174, each including an outwardly radially extending catch 178 at the free end of each leg 174. The lower surface of each catch 178 includes a first lower pushing surface 180 that is perpendicular to the extending direction of legs 178, and a second lower beveled or inclined surface 182 that extends radially outward from first lower pushing surface 180. Joint push button actuator 170 is slidably positioned in central circular opening 152 of outer pivot joint member 102, with legs 176 and catches 178 extending through respective square through openings 150. In order to accomplish this, joint push button actuator 170 is preferably made from a plastic material. As a result, during initial assembly, when joint push button actuator 170 is pressed into central circular opening 152 of outer pivot joint member 102, second lower beveled surface 182 of each leg 174, upon engaging with fourth transverse wall 154, rides therealong and forces radially inward flexion of each leg 174. Once each catch 178 passes through a respective square through opening 150, each leg 178 springs back out so that each catch 178 is positioned on the opposite side of bottom wall 146.

When a person pushes joint push button actuator 170 inwardly of central circular opening 152 of outer pivot joint member 102, first lower pushing surfaces 180 press against annular planar end wall 162 of joint lock 158 in order to bias joint lock 158 out of central circular opening 140, thereby permitting pivoting of inner and outer pivot joint members 100 and 102 relative to each other so that portable bassinet 10 can be folded to the positions shown in FIGS. 3 and 4. During this pivoting movement, arcuate limiter projection wall 148 moves within arcuate limiter recess 122 until the opposite end of arcuate limiter projection wall 148 abuts against the opposite end of arcuate limiter recess 122, thereby providing a limiting stop.

Referring now to FIGS. 2, 6, 20 and 21, first and second lower pivot connection assemblies 96 and 98 each pivotally connect upper ends of legs 60, as well as serving as a vertical sliding guide for metal slide plate 50.

Specifically, each lower pivot connection assembly 96 and 98 includes two parallel, spaced apart inner and outer side plates 184 and 186. Each side plate 184 and 186 includes a central concave upper edge 188 which terminates at opposite ends at convex side edges 190. An upper concave connecting plate 192 connects together central concave upper edges 188 and a vertically oriented, central planar connecting plate 194 connects together side plates 184 and 186 at centers thereof. As a result, connecting plates 192 and 194 maintain side plates 184 and 186 in parallel, spaced apart relation. It will be appreciated, as shown in FIG. 2, that the curvature of upper concave connecting plate 192 corresponds to the outer curvature of cylindrical pivot sections 106 of pivot joint members 100 and 102, but spaced slightly therebelow.

Each side plate 184 and 186 includes two openings 196 at positions in line with opposite ends of central concave upper edges 188 thereof.

Further, stop blocks 198 are provided on opposite sides of central planar connecting plate 194 at lower portions thereof, and function as limiting stops for the free ends of legs 60 when portable bassinet 10 is in its open operating position shown in FIG. 2.

Lastly, a U-shaped guide 200 is formed on the inner facing surface of each inner side plate 184, thereby defining a slot-like opening 202 between the inner facing surface of each inner side plate 184 and U-shaped guide 200 through which metal slide plate 50 is guided for vertical sliding movement.

With this arrangement, the upper ends of legs 60 extend between side plates 184 and 186, with openings **64*b* in legs 60 being in alignment with openings 196 in side plates 184 and 186, and rivets 204 extending therethrough so as to pivotally connect the upper ends of legs 60 to lower pivot connection assemblies 96 and 98. It will be appreciated that, when portable bassinet 10 is in its fully assembled, open and operational position, as shown in FIG. 2, the free upper ends of legs 60 will pivot into contact with the upper ends of stop block 198** so as to limit the pivoting movement thereof.

Figure 2A:
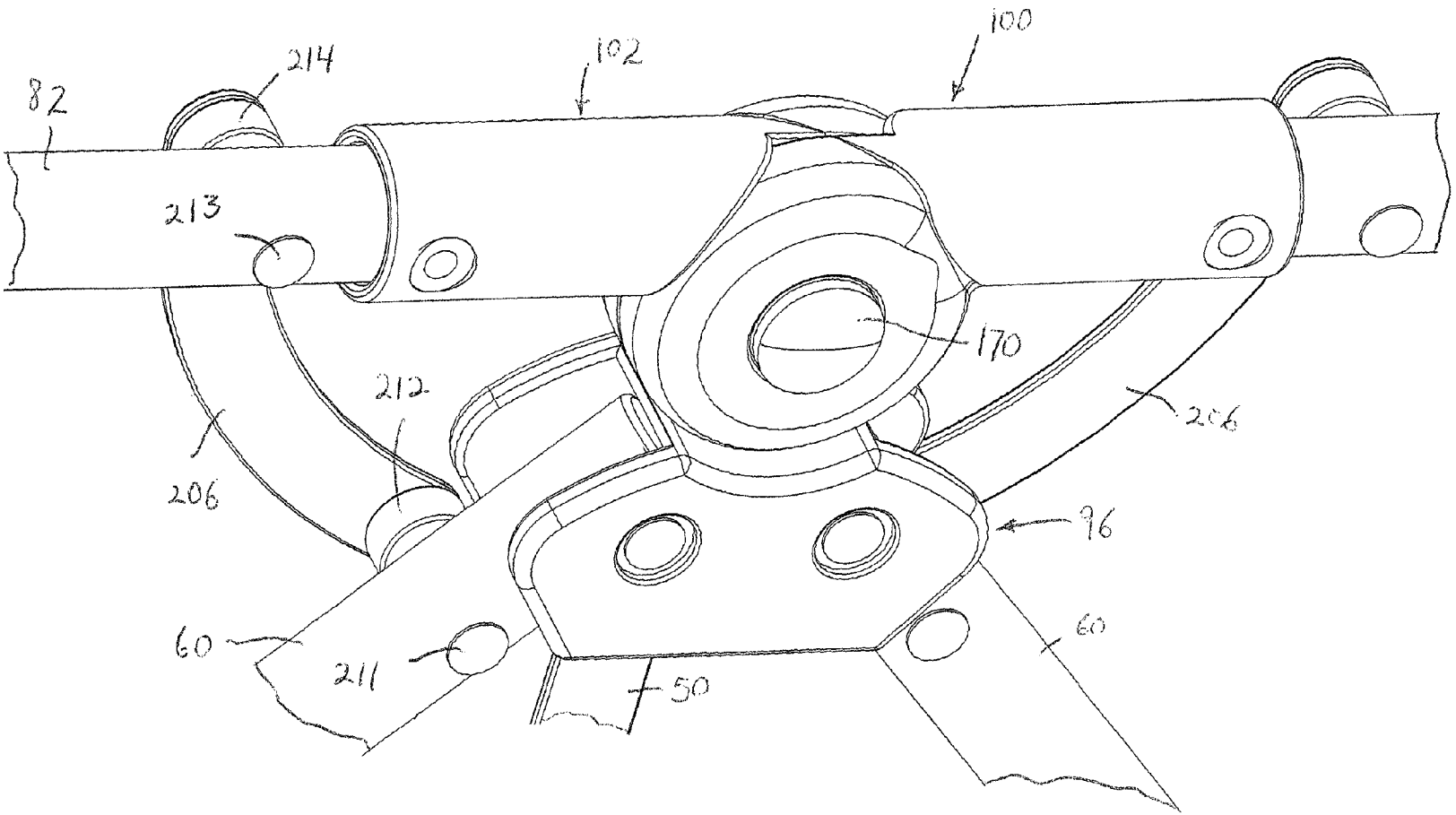
FIG. 2A is an enlarged perspective view of the portion of the frame, showing the pivoting connection assembly.

Further, as shown in FIGS. 2, 2A and 6, arcuate metal plates 206 are provided and each have openings 208 and 210 at opposite ends thereof. Each opening 208 is in alignment with an opening **64*a* in a leg 60 and through which a rivet 211 extends, with a cylindrical spacer 212 therebetween, and each opening 210 is in alignment with an opening 88 in a respective upper tubular support member 78, 80 and through which a rivet 213 extends, with a cylindrical spacer 214** therebetween.

Thus, in operation, in the open functional position of FIG. 2, upper tubular support members 78 and 80 are coplanar with each other, and mattress support halves 24 and 26 are also coplanar with each other in parallel, spaced apart relation below upper tubular support members 78 and 80. Portable bassinet 10 is locked in this position by reason of joint lock 158 being positioned in central circular opening 114 and tab openings 116 of cylindrical pivot section 106 as well as central circular opening 140 and tab openings 142 of cylindrical pivot section 130, so as to prevent relative rotation of inner and outer pivot joint members 100 and 102.

In order to collapse and close portable bassinet 10 into a compact configuration, as shown in FIGS. 3 and 4, joint push button actuator 170 is pressed in. As a result, second lower beveled surfaces 182 of joint push button actuator 170 press against annular planar end wall 162 of joint lock 158 in order to bias joint lock 158 out of central circular opening 140 of cylindrical pivot section 130, thereby permitting pivoting of inner and outer pivot joint members 100 and 102 relative to each other so that portable bassinet 10 can be folded to the positions shown in FIGS. 3 and 4. At such time, as shown first in FIG. 3, upper pivot connection assemblies 92 and 94 move upwardly away from first and second lower pivot connection assemblies 96 and 98. Since the upper end of elongated metal slide plate 50 is connected to upper pivot connection assemblies 92 and 94, elongated metal slide plate 50 also moves upwardly. This results in the pivoting of mattress support halves 24 and 26 around rivets 56 whereby inner linear transverse edges 28 move upwardly and rounded edges 34 move downwardly to collapse portable bassinet 10. Since joint lock 158 is still in engagement with central circular opening 114 and tab openings 116 at this time, it rotates with cylindrical pivot section 106. At this time, however, during the rotation of inner and outer pivot joint members 100 and 102 relative to each other, tab openings 116 and 142 are out of alignment with each other so that joint lock 158 cannot lock these elements together. It is only when they are rotated to the fully collapsed position shown in FIG. 4 that tab openings 116 and 142 are in alignment with each other so that joint lock 158 can now enter both tab openings 116 and 142 to releasably lock these elements together.

Figure 22:
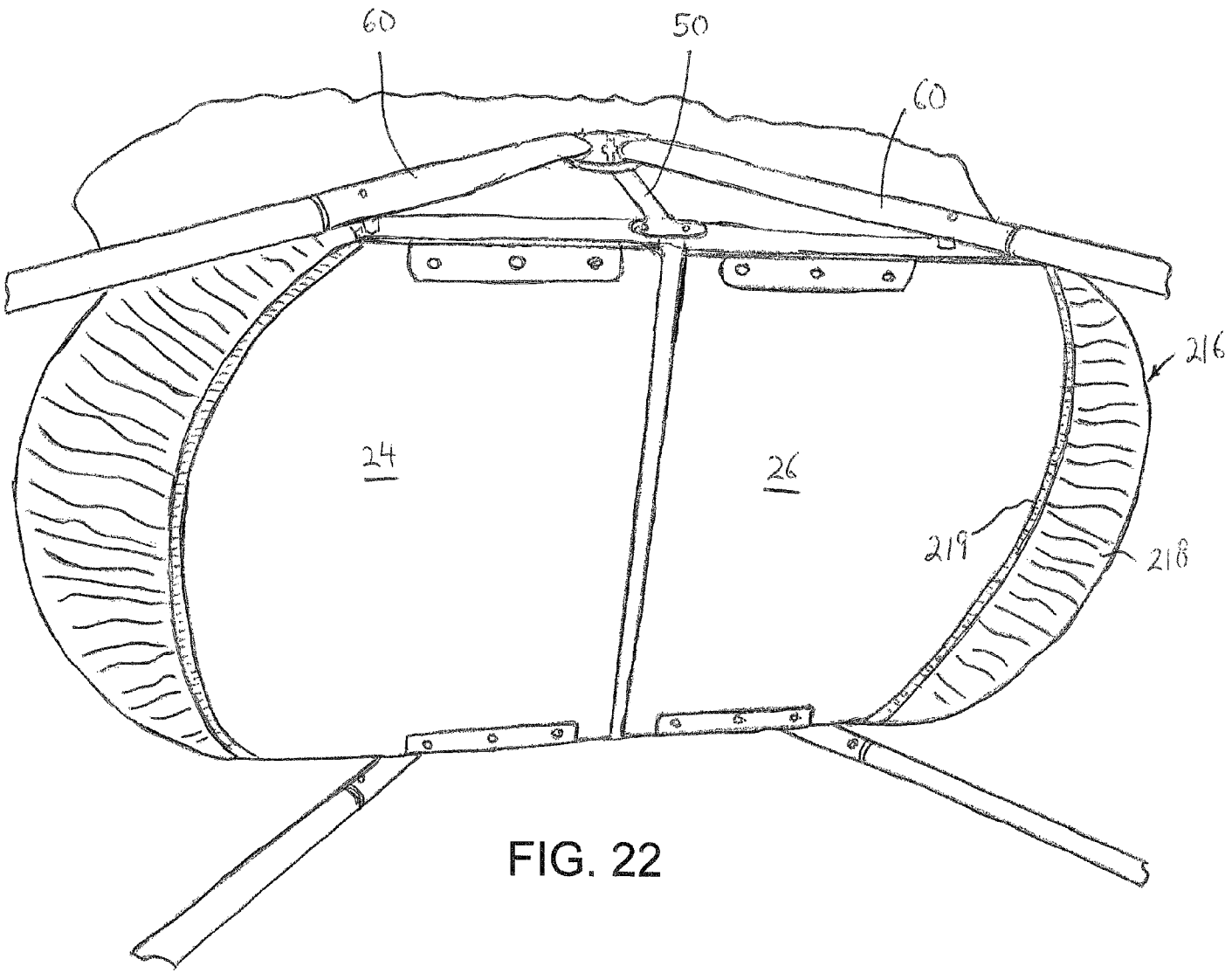
FIG. 22 is a bottom perspective view of the bottom of the bassinet showing the flexible fabric attached to the mattress support halves.
Figure 23:
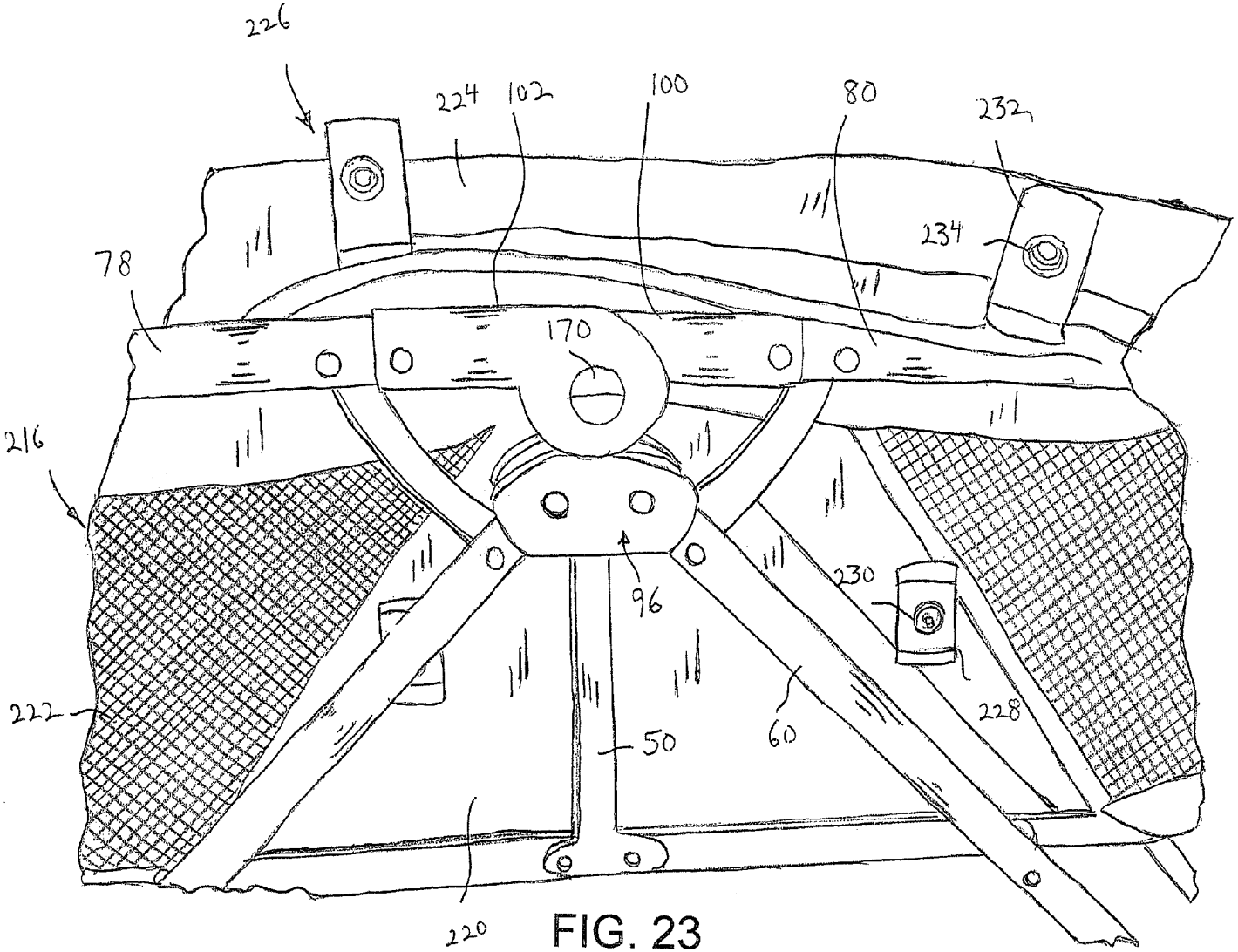
FIG. 23 is a perspective view of a portion of the side of the bassinet, showing the flexible fabric side wall partially assembled to the frame.
Figure 24:
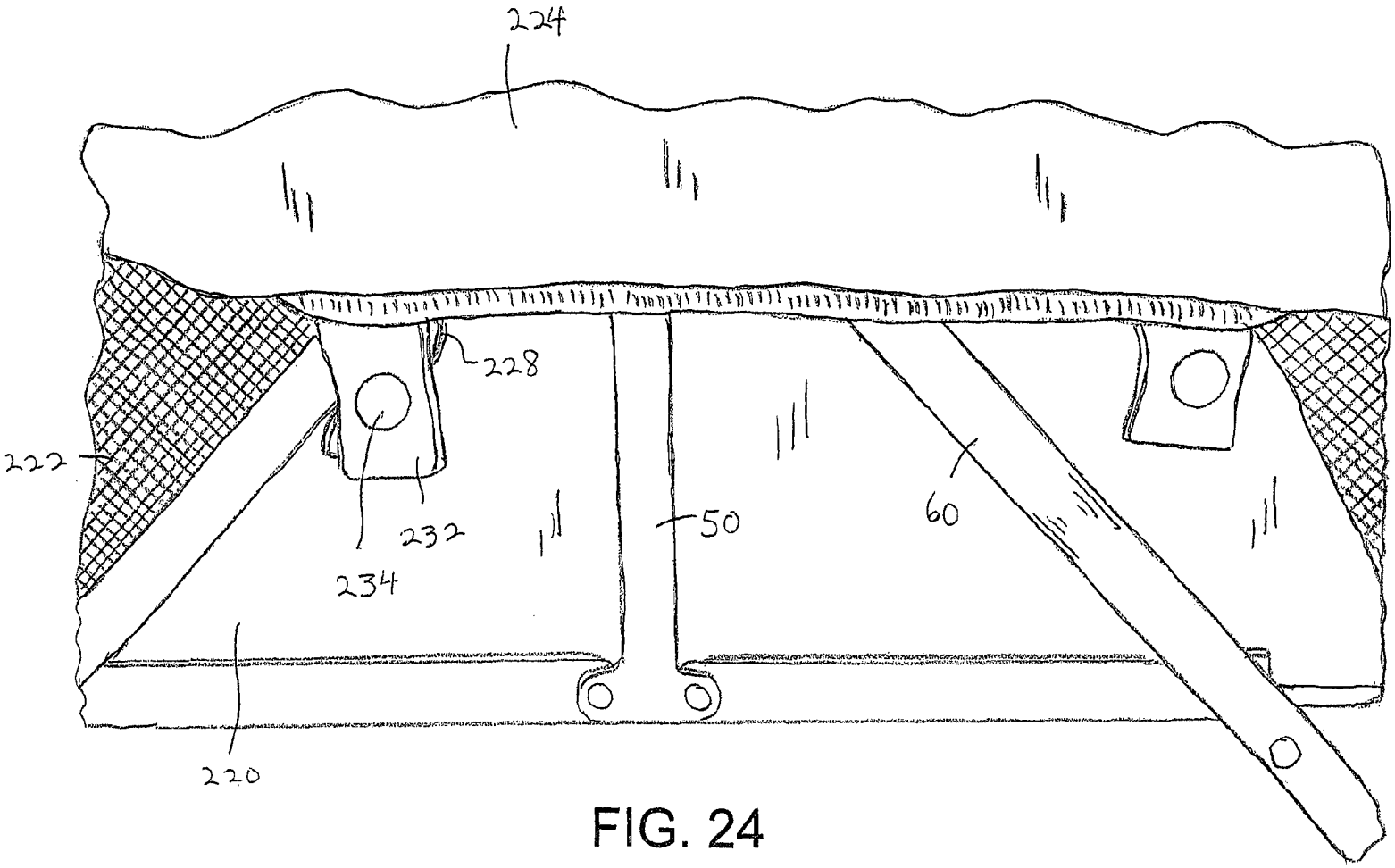
FIG. 24 is a perspective view of a portion of the side of the bassinet, showing the flexible fabric side wall attached to one of the legs of the frame.

It will be appreciated that bassinet frame 12 is covered with a fabric covering 216, as shown in FIGS. 1 and 22-24. Specifically, fabric covering 216 includes a base fabric covering section 218 that covers mattress support halves 24 and 26 and which is secured thereto by elastic ends 219 thereof, that is, an elastic material sewn into the ends thereof, that stretch over rounded edges 34 thereof, as shown in FIG. 22 thereof. As shown in FIG. 23, a side skirt fabric section 220 extends upwardly from base fabric covering section 218 from the periphery of mattress support halves 24, and within the confines of legs 60. Side skirt fabric section 220 can have mesh sections 222, as is well known. An upper fabric section 224 is secured to the upper end of side skirt fabric section 220 and extends up and over upper tubular support members 78 and 80 to the outside of bassinet frame 12. A snap fastener fabric securing arrangement 226 is provided for securing fabric covering 216 is place. Fabric securing arrangement 226 includes first fabric tabs 228 secured to sides of side skirt fabric section 220, each tab 228 having a first snap fastening element 230 thereon, and second fabric tabs 232 secured to free ends of upper fabric section 220 that extends to the outside of bassinet frame 12, each tab 232 having a second snap fastening element 234 thereon. Thus, as shown in FIG. 24, with each first snap fastening element 230 positioned to the inside of bassinet frame 12 and below a leg 60, each second snap fastening element 234 is pulled down over the outside of each leg 60 for snap fastening engagement with a respective first snap fastening element 230. However, it will be appreciated that the manner of securement of fabric covering 216 to bassinet frame 12 is not limited by this arrangement.

Thereafter, a mattress (not shown) is positioned on mattress support halves 24 and 26 which are covered by base fabric covering section 218.

It will be appreciated that various modifications can be made to the present invention, within the scope of the claims. For example, although vertically oriented, elongated metal slide plate 50 has been shown to be linear and arranged in a vertical orientation, it can be arranged at an angle to the vertical, and can even be arcuate so that the opening and closing does not follow a linear path.

Having described a specific preferred embodiment of the invention with reference to the accompanying drawings, it will be appreciated that the present invention is not limited to that precise embodiment and that various changes and modifications can be effected therein by one of ordinary skill in the art without departing from the scope or spirit of the invention as defined by the appended claims.

What is claimed is:

1. A portable bassinet comprising:

first and second mattress support halves, a lower pivoting arrangement secured to the first and second mattress support halves for providing pivoting movement of said first and second mattress support halves between an open operative position where the mattress support halves are coplanar, and a closed storage position where the mattress support halves are in parallel, spaced apart relation to each other, a lower support connected with the mattress support halves for supporting the mattress support halves on a ground surface, an upper support frame including first and second upper support members, an upper pivoting arrangement secured to the first and second upper support members for providing pivoting movement of said first and second upper support members between said open operative position where the first and second upper support member are coplanar, and said closed storage position where the upper support members are in parallel, spaced apart relation to each other, and at least one connection member which connects said lower pivoting arrangement to said upper pivoting arrangement such that said lower pivoting arrangement and said upper pivoting arrangement are always a fixed distance from each other during movement of the bassinet between said open operative position and said closed storage position.

2. A portable bassinet according to claim 1, wherein said at least one connection member includes at least one elongated member having a lower end which is connected to and forms said lower pivoting arrangement and an upper end which is connected to said upper pivoting arrangement.

3. A portable bassinet according to claim 2, wherein:

the lower pivoting arrangement includes a first lower pivoting assembly secured to the first and second mattress support halves at one side of the bassinet and a second lower pivoting assembly secured to the first and second mattress support halves at an opposite side of the bassinet, the upper pivoting arrangement includes a first upper pivoting assembly secured to the first and second upper support members at said one side of the bassinet and a second upper pivoting assembly secured to the first and second upper support members at said opposite side of the bassinet, and said at least one connection member includes a first elongated member at said one side of said bassinet and having said lower pivoting arrangement at a lower end thereof, and a second elongated member at said opposite side of said bassinet and having said lower pivoting arrangement at a lower end thereof.

4. A portable bassinet according to claim 3, wherein said lower pivoting arrangement includes a transverse extension at the lower end of each of said first and second elongated members, and a pivot extends through each of opposite ends of said transverse extension for pivotal connection with a respective said mattress support half.

5. A portable bassinet according to claim 4, wherein said lower pivoting arrangement includes a bracket connected to each side of each mattress support half, and said pivot extends through each of opposite ends of said transverse extension for pivotal connection to a respective said bracket.

6. A portable bassinet comprising:

first and second mattress support halves, a lower pivoting arrangement secured to the first and second mattress support halves for providing pivoting movement of said first and second mattress support halves between an open operative position where the mattress support halves are coplanar, and a closed storage position where the mattress support halves are in parallel, spaced apart relation to each other, first and second lower support legs on each side of said bassinet and connected with the mattress support halves for supporting the mattress support halves on a ground surface, an upper support frame including first and second upper support members, an upper pivoting arrangement secured to the first and second upper support members for providing pivoting movement of said first and second upper support members between said open operative position where the first and second upper support member are coplanar, and said closed storage position where the upper support members are in parallel, spaced apart relation to each other, and a leg pivoting arrangement for pivotally connecting upper ends of said first and second lower support legs on each side of said bassinet, with said leg pivoting arrangement being movable toward said upper pivoting arrangement when said bassinet is moved to said open operative position and away from said upper pivoting arrangement when said bassinet is moved to said closed storage position.

7. A portable bassinet according to claim 6, wherein:

the leg pivoting arrangement includes a first leg pivoting assembly pivotally secured to the upper ends of the first and second lower support legs at one side of the bassinet and a second leg pivoting assembly pivotally secured to the upper ends of the first and second lower support legs at an opposite side of the bassinet, and the upper pivoting arrangement includes a first upper pivoting assembly secured to the first and second upper support members at said one side of the bassinet and a second upper pivoting assembly secured to the first and second upper support members at said opposite side of the bassinet.

8. A portable bassinet according to claim 7, wherein each of said leg pivoting assemblies includes first and second side plates, and at least one connecting member for connecting together said first and second side plates in spaced apart relation, with upper ends of the legs pivotally connected to at least one of said first and second side plates, and positioned therebetween.

9. A portable bassinet according to claim 8, wherein each of said leg pivoting assemblies includes a stop member on said at least one connecting member for limiting an angular pivoting range in one direction of said legs.

10. A portable bassinet according to claim 8, wherein said at least one connecting member includes a concave upper connecting member which is positioned immediately below said upper pivoting arrangement in said open operative position.

11. A portable bassinet according to claim 8, further comprising at least one connection member which connects said lower pivoting arrangement to said upper pivoting arrangement such that said lower pivoting arrangement and said upper pivoting arrangement are always a fixed distance from each other during movement of the bassinet between said open operative position and said closed storage position.

12. A portable bassinet according to claim 11, wherein:

said at least one connection member includes at least one elongated member having a lower end which is connected to and forms said lower pivoting arrangement and an upper end which is connected to said upper pivoting arrangement; and each of said leg pivoting assemblies includes a guide on one of said first and second side plates, which guides a respective said elongated member for sliding movement relative to said leg pivoting arrangement when said bassinet is moved between said open operative position and said closed storage position.

13. A portable bassinet according to claim 6, further including connecting members which connect together upper ends of said legs and the first and second upper support members.

14. A portable bassinet comprising:

first and second mattress support halves, a lower pivoting arrangement secured to the first and second mattress support halves for providing pivoting movement of said first and second mattress support halves between an open operative position where the mattress support halves are coplanar, and a closed storage position where the mattress support halves are in parallel, spaced apart relation to each other, a lower support connected with the mattress support halves for supporting the mattress support halves on a ground surface, an upper support frame including first and second upper support members, and an upper pivoting arrangement secured to the first and second upper support members for providing pivoting movement of said first and second upper support members between said open operative position where the first and second upper support member are coplanar, and said closed storage position where the upper support members are in parallel, spaced apart relation to each other, the upper pivoting arrangement including a first pivot joint member connected to the first upper support member, a second pivot joint member connected to the first upper support member and rotatably connected to the first pivot joint member, and a joint lock movable between a first position in engagement with the first and second pivot joint members to prevent rotational movement therebetween and a second position out of engagement with one of said first and second pivot joint members to permit rotational movement therebetween.

15. A portable bassinet according to claim 14, wherein the first pivot joint member includes a first locking recess, the second pivot joint member includes a second locking recess, and the joint lock is positioned within the first and second locking recesses in said open operational position to prevent rotational movement between said first and second pivot joint members.

16. A portable bassinet according to claim 15, wherein each of said first and second locking recesses includes a circular recess with radially extending tab recesses, and said joint member includes a main cylindrical body to fit within said circular recesses and radially extending tabs to fit within said tab recesses.

17. A portable bassinet according to claim 15, wherein the upper pivoting arrangement further includes:

a biasing arrangement for biasing said joint member to maintain said joint member in said first and second locking recesses to prevent rotational movement between said first and second pivot joint members, and an actuator for moving said joint member out of one of said first and second locking recesses to permit rotational movement between said first and second pivot joint members.

18. A portable bassinet according to claim 17, wherein said actuator includes a push button axially movable along a pivot axis of said first and second pivot joint members for pressing against said joint member to move said joint member out of one of said first and second locking recesses against a force from said biasing arrangement.

19. A portable bassinet according to claim 17, wherein said biasing arrangement is a coil spring located in one of said first and second locking recesses.

20. A portable bassinet according to claim 14, wherein said first pivot joint member includes an arcuate projection, and said second pivot joint member includes an arcuate recess which receives said arcuate projection for arcuate movement therein so as to define an angular range of motion between said first and second pivot joint members.

* * * * *